US009409700B1

(12) United States Patent
Haling

(10) Patent No.: US 9,409,700 B1
(45) Date of Patent: Aug. 9, 2016

(54) NOZZLE PROTECTOR ASSEMBLY

(71) Applicant: Trent Haling, Rowlett, TX (US)

(72) Inventor: Trent Haling, Rowlett, TX (US)

( * ) Notice: Subject to any disclaimer, the term of this patent is extended or adjusted under 35 U.S.C. 154(b) by 0 days.

(21) Appl. No.: 14/552,297

(22) Filed: Nov. 24, 2014

Related U.S. Application Data

(60) Provisional application No. 61/907,771, filed on Nov. 22, 2013.

(51) Int. Cl.
*B65D 83/28* (2006.01)
*B05B 15/00* (2006.01)
*B65D 83/20* (2006.01)

(52) U.S. Cl.
CPC ..... *B65D 83/28* (2013.01); *B05B 15/001* (2013.01); *B65D 83/207* (2013.01)

(58) Field of Classification Search
CPC .... B05B 15/001; B65D 83/20; B65D 83/203; B65D 83/40; B65D 83/16; B65D 83/205; B65D 83/207; B65D 83/28
USPC ..... 239/288–288.5; 222/182, 402.13
See application file for complete search history.

(56) References Cited

U.S. PATENT DOCUMENTS

| | | | | |
|---|---|---|---|---|
| 3,038,633 | A | 6/1962 | Hfoster | |
| 3,958,726 | A | 5/1976 | Trotta | |
| 3,998,361 | A | 12/1976 | Arena | |
| 4,053,090 | A | 10/1977 | Kelly et al. | |
| 4,301,947 | A | 11/1981 | Potter | |
| 4,416,399 | A * | 11/1983 | Parr | B65D 83/228 222/402.13 |
| 5,735,464 | A | 4/1998 | Darrach, III | |
| 5,975,377 | A * | 11/1999 | McGowens | B65D 83/205 222/402.13 |
| 8,261,946 | B2 | 9/2012 | Grant | |

FOREIGN PATENT DOCUMENTS

WO 2006129077 12/2006

OTHER PUBLICATIONS

"Lotrimin® AF Athlete's Foot Deodorant Powder Spray", https://lotrimin.com/our-products/athlete-deodorant-powder.php, 2014, 1.

* cited by examiner

*Primary Examiner* — Christopher Kim
(74) *Attorney, Agent, or Firm* — Isaac Estrada; Deborah Peacock; Peacock Myers, P.C.

(57) ABSTRACT

A decor-able, multiple-configuration protector for the nozzle assembly of a spray can having parts capable of absorbing, deflecting, and/or redirecting damaging force from accidental drops and bumps.

18 Claims, 51 Drawing Sheets

NOZZLE PROTECTOR ASSEMBLY

CROSS-REFERENCE TO RELATED APPLICATIONS

This application claims priority to and the benefit of the filing of U.S. Provisional Patent Application Ser. No. 61/907,771, entitled "NOZZLE PROTECTOR COVER", filed on Nov. 22, 2013, and the specification and claims thereof are incorporated herein by reference.

BACKGROUND OF THE INVENTION

1. Field of the Invention (Technical Field)

Embodiments of the present invention relate to aerosol spray can accessories, and more particularly to nozzle protectors.

2. Description of Related Art

Most ordinary spray cans comprise a cylindrical body and a top dome attached by a rolled over and sealed first joint. At its top, the dome comprises a nozzle valve cup assembly that is typically centrally disposed and recessed, and attached to the dome through a rolled over and sealed second joint. A discharge tube protrudes from the center of the valve cup, to which a nozzle, typically comprising an actuator button with an aperture, attaches to spray the contents of the can when pressed. Most spray cans comprise covers to isolate the spray nozzle from the environment and protect it and/or assist in packaging and stacking. The cover typically snaps onto/into the first joint (between the cylindrical body and the dome) or, less commonly, the second joint (between the dome and the valve plate). The cover typically stays on while the can is not being used.

A common problem with the spray cans of the type described above is that the discharge tube and nozzle often break off if, for example, the can is accidentally dropped. The industry has responded by providing removable nozzle protectors that may be purchased separately and attached to the dome, or by turning modified covers into nozzle protectors (e.g., cap actuators) that snap onto/into the first joint (between the cylindrical body of the can and the dome). A device that protects spray cans from damage during drops must possess several qualities. Although there are aerosol cans that cost above $20 dollars, they are in the minority, so a protector designed to protect the majority of products should be simple and inexpensive to manufacture. It should be durable enough to protect the heaviest cans, which may weigh up to 22 ounces and hit the ground with a force greater than 350 pounds when dropped, and be able to be used with confidence on the most expensive products, such as a mink oil hair spray selling for $96. The types of modified covers and nozzle removable protectors currently being used seem primarily designed to protect during shipping and display and to facilitate stacking. They are very stiff and fracture easily during impact, often resulting in damage during use, at home and in the workplace, to the actuator/valve cup assembly.

Embodiments of the present invention solve this problem by providing durable nozzle protectors that preferably snap onto the second joint (between the dome and the valve plate) and that are openable/closable. A user can conveniently twist a shell component of an embodiment of the present invention to switch between an open and a closed configuration, allowing the use of the spray can while an embodiment of the present invention is installed. Embodiments of the present invention can substitute other nondurable, stiff, bulkier cover/nozzle protectors that only have an open configuration.

BRIEF SUMMARY OF THE INVENTION

Embodiments of the invention comprise a protector for a nozzle actuator assembly for an aerosol spray can comprising a circular base comprising a top surface and a bottom surface, said top surface comprising at least one cylindrical upward first projection that forms one or more walls to protect said nozzle actuator assembly, said bottom surface comprising a downward cylindrical second projection at its outermost periphery that forms a lower rim, said lower rim comprising a concentric first ridge, and a shell comprising at least two opposing openings. In one embodiment, the first ridge is curved inwardly and its most inner perimeter is smaller than an outer diameter of a rolled joint of the spray can. Preferably, the shell component is detachable from the base. Preferably, the top surface of the base comprises a cylindrical upward third projection smaller in diameter than the inner diameter of the shell, and onto which the shell connects in such a way that the shell can rotate relative to the base.

Preferably, the top surface of the base further comprises a cylindrical upward fourth projection placed outwardly in relation to the third projection and larger in diameter than the outer diameter of the shell and comprises a first detent. Preferably the shell comprises a second and third detents that are capable of interlocking with the first detent to lock the shell in either an open or closed configuration.

In one embodiment, the third and fourth projections comprise a cutout portion to allow a spray to flow unrestricted.

In one embodiment, the shell comprises a top opening, preferably circular in shape and which is capable of accommodating decorative attachments.

In one embodiment, the base component clamps around the rolled joint of a spray can.

In a different embodiment, the shell and the base further comprise hooks to accommodate restraints.

In another embodiment, the shell extends downward over the base and is capable of being clamped over the rolled joint.

In a different embodiment, the shell is detachably connected or fixed to one or more walls to protect the nozzle assembly and is shaped as an arching bridge with enough space under it to allow the finger of a user to enter to operate the nozzle assembly on one side and to allow spray to exit the nozzle assembly unrestricted on the other side of the shell. Preferably the base and the shell are molded out of plastic.

In another embodiment, the shell opposing openings are sufficiently large to allow the finger of a user to enter to operate said nozzle assembly on one side and to allow spray to exit the nozzle assembly unrestricted on the other side of the shell.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
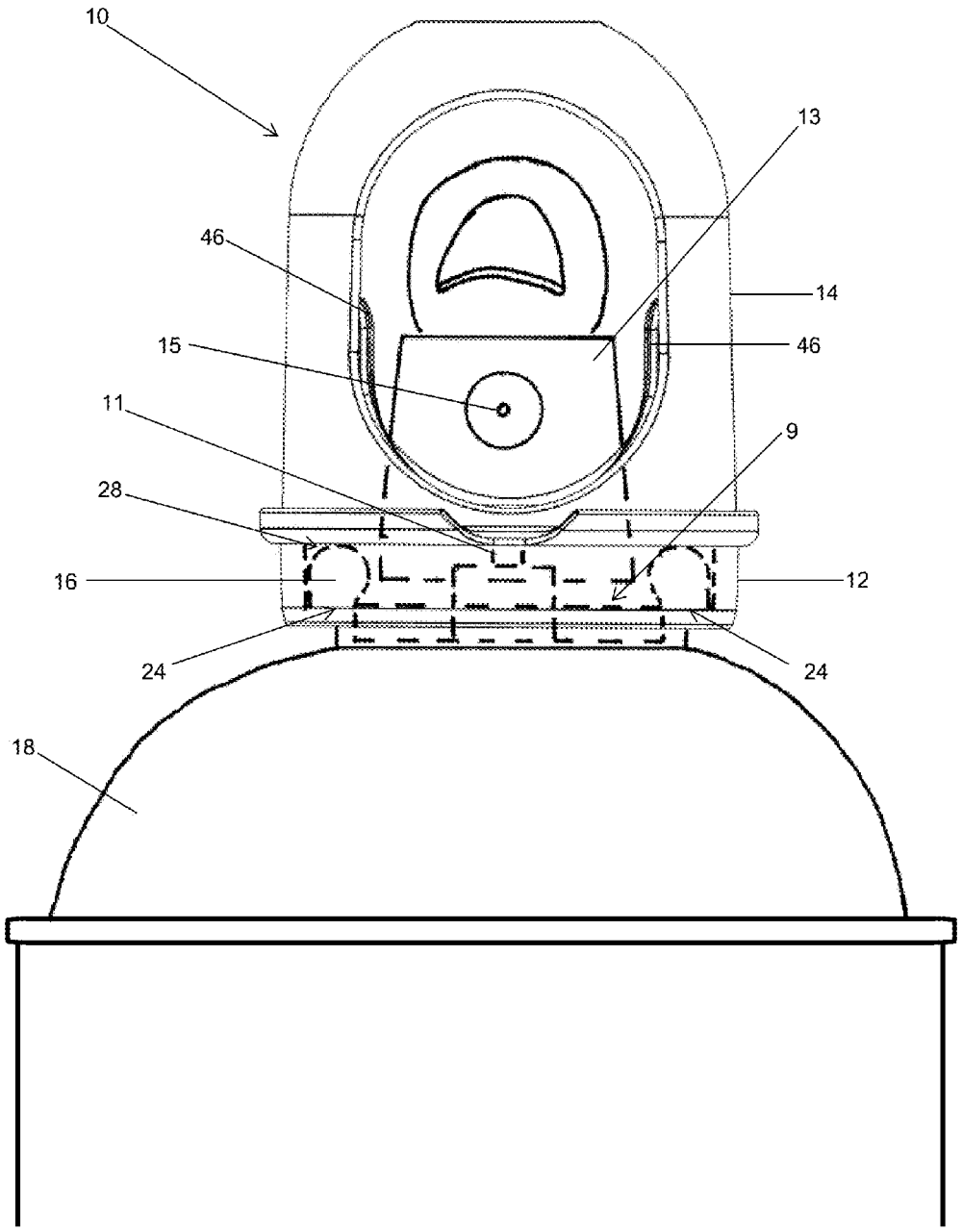
FIG. 1 is a front view of an embodiment of the present invention disposed on the joint between the dome of a spray can and its valve plate showing the position of the nozzle assembly and the finger of a user.

In the following detailed description, numerous specific details are set forth in order to provide a thorough understanding of the embodiments of the invention. However, it will be understood by one of ordinary skill in the art that the embodiments may be practiced without these specific details. For instance, well known operation or techniques may not be shown in detail. Technical and scientific terms used in this description have the same meaning as commonly understood to one or ordinary skill in the art to which this subject matter belongs.

As used throughout this specification and claims, the term "protector" refers to fixtures that are capable of absorbing, deflecting, or redirecting force that can potentially damage, for example, the discharge tube or nozzle actuator of a spray/aerosol can, or simply cover a nozzle assembly for, for example, partial isolation from the elements, or serve as a base for additional fixtures such as holders, ornaments, etc.

As used throughout this specification and claims, the term "can", as in "spray can" refers to containers to spray products that may be manufactured from any materials, including metal, plastic, etc.

Referring to the figures, one embodiment of the present invention comprises nozzle protector 10, preferably manufactured of a suitable material, for example, plastic commodity resins such as PVC, PE, PS, Nylon, Rubber, Silicon, or Vinyl (but not limited thereto), but can also be made of other suitable materials such as metals, for example, aluminum, tin, etc. Nozzle protector 10 preferably comprises base component 12 and shell 14. In one embodiment, base component 12 is formed from a relatively short cylinder with an inner diameter approximating the size of sealed joint 16 of spray can 18. See FIGS. 1-2. Preferably base component 12 is manufactured of a material offering sufficient resilience to easily snap onto sealed joint 16. Also shown are valve cup 9 (in ghost lines), discharge tube 11, nozzle actuator button 13, and aperture 15.

Figure 2:
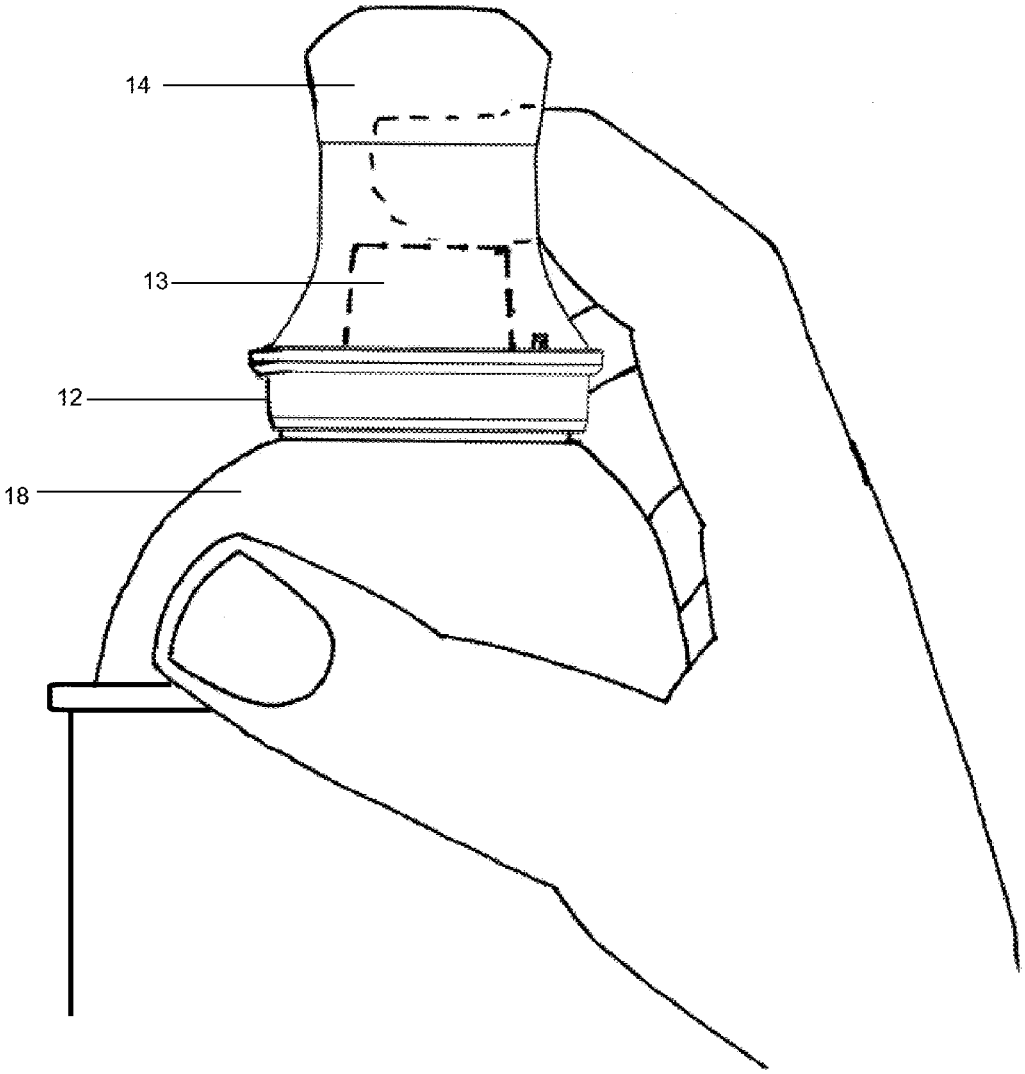
FIG. 2 is a side view of the embodiment of FIG. 1 disposed on the can.
Figure 3:
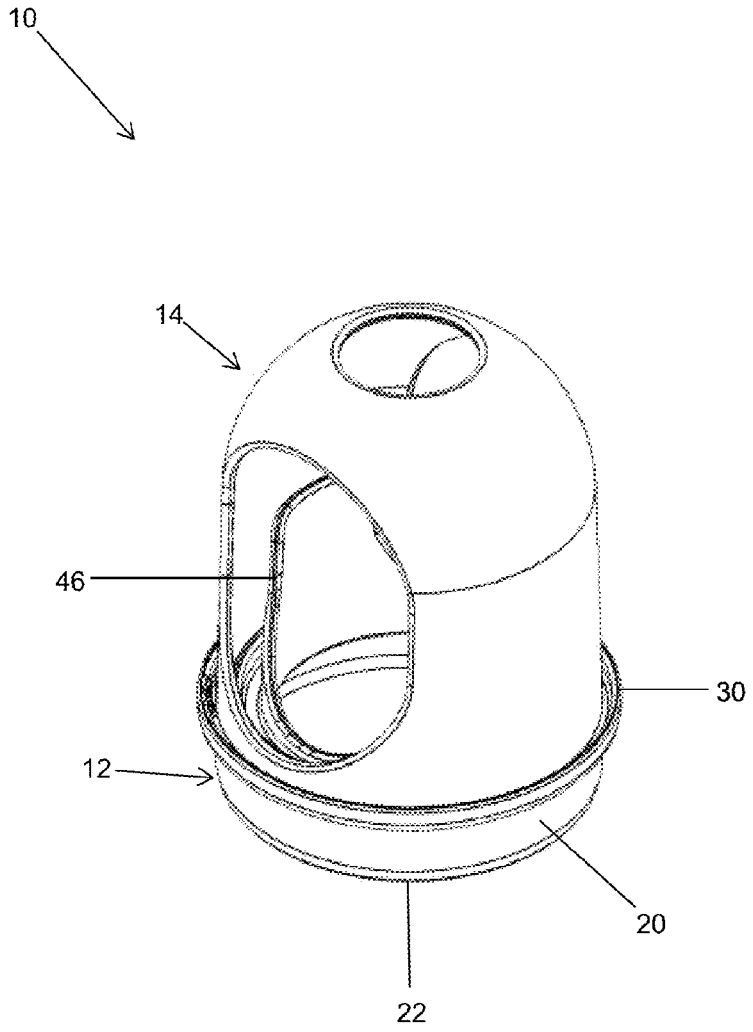
FIG. 3 is an isometric view of the embodiment of FIG. 1 without the spray can in the open configuration.
Figure 4:
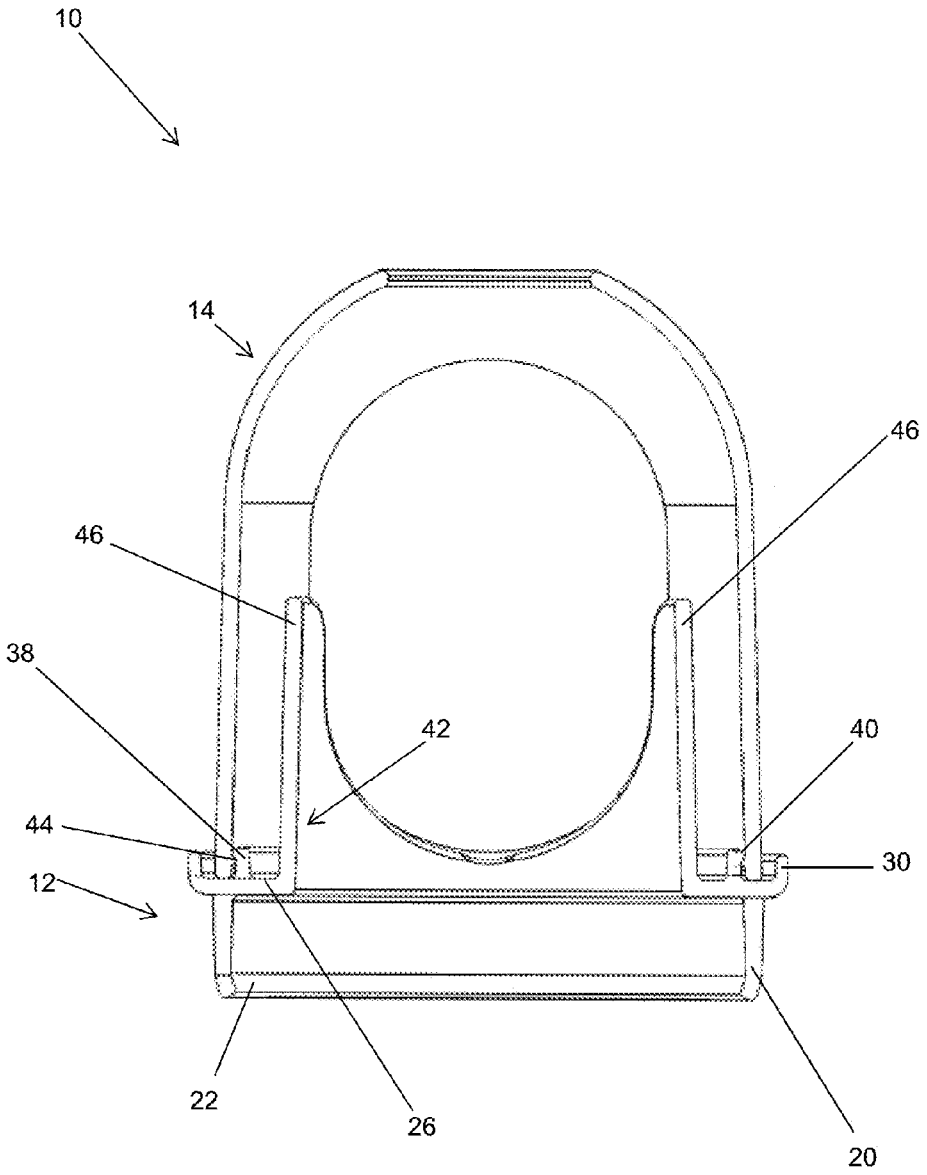
FIG. 4 is a cross-sectional view of the embodiment of FIG. 3 in the open configuration.
Figure 5A:
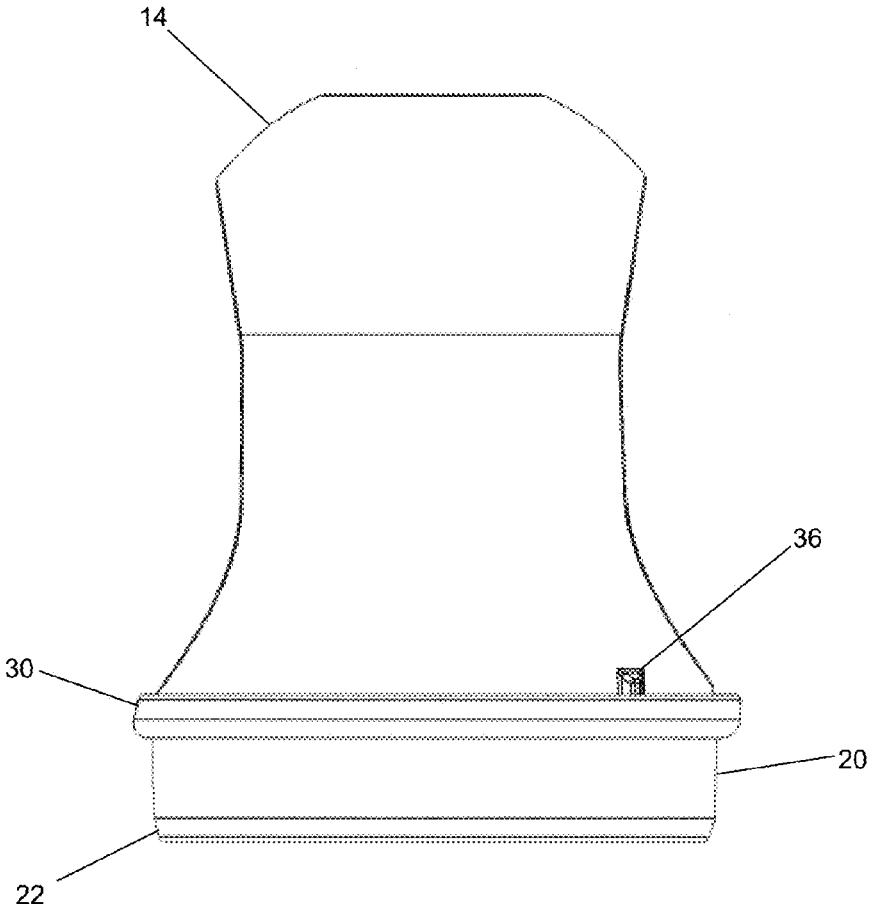
FIGS. 5A and 5B are left (A) and right (B) views of the embodiment of FIG. 3 in the open configuration.
Figure 5B:
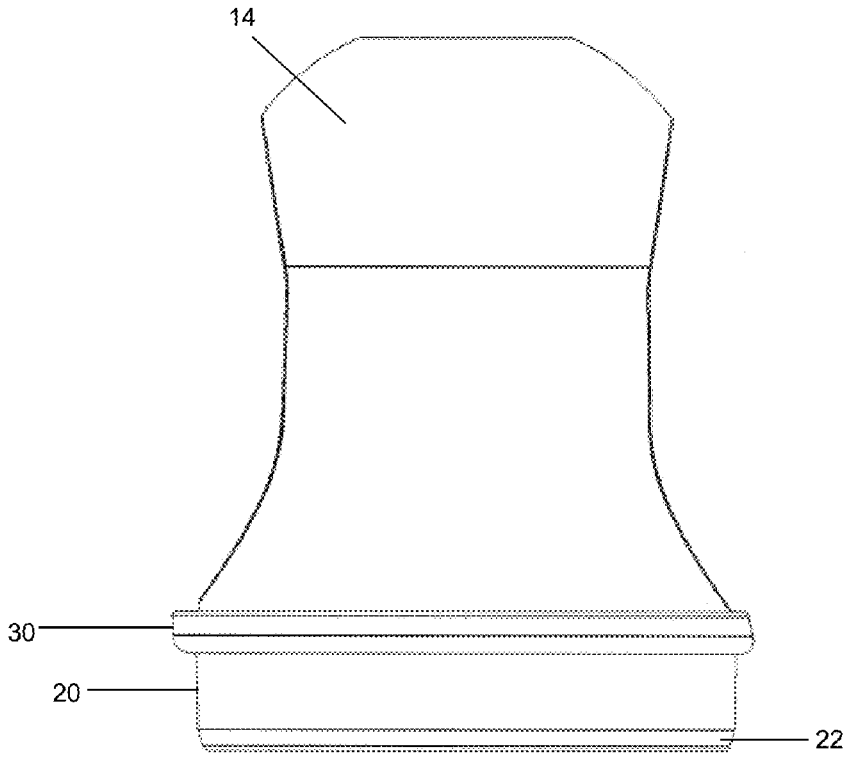
Figure 6:
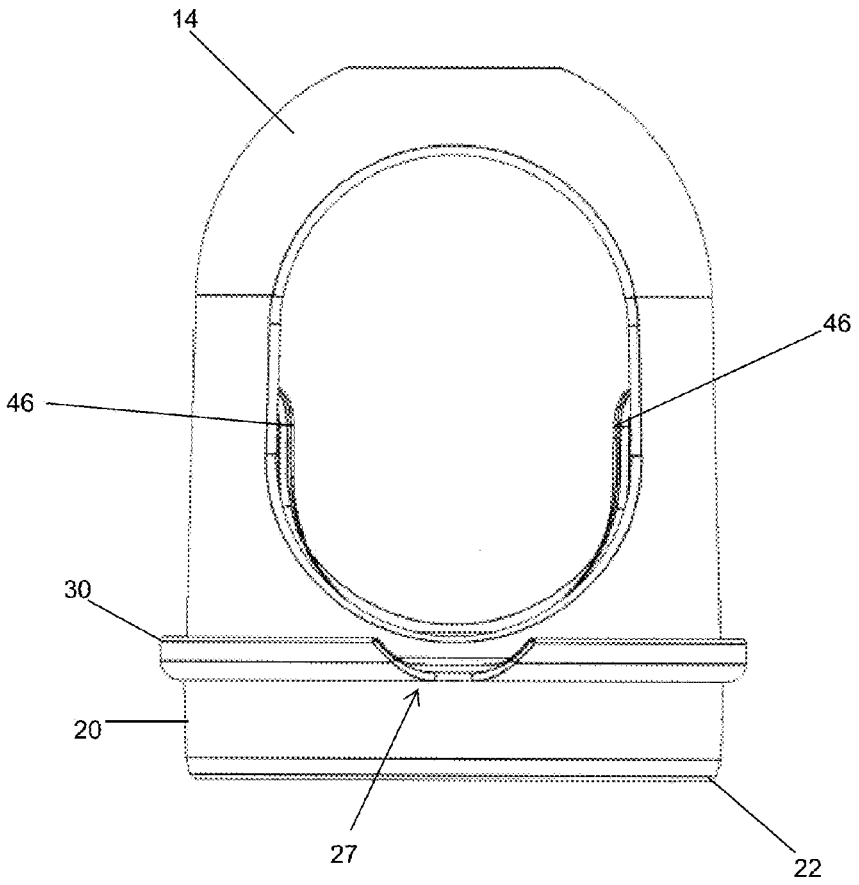
FIG. 6 is a front view of the embodiment of FIG. 3 in the open configuration.
Figure 7:
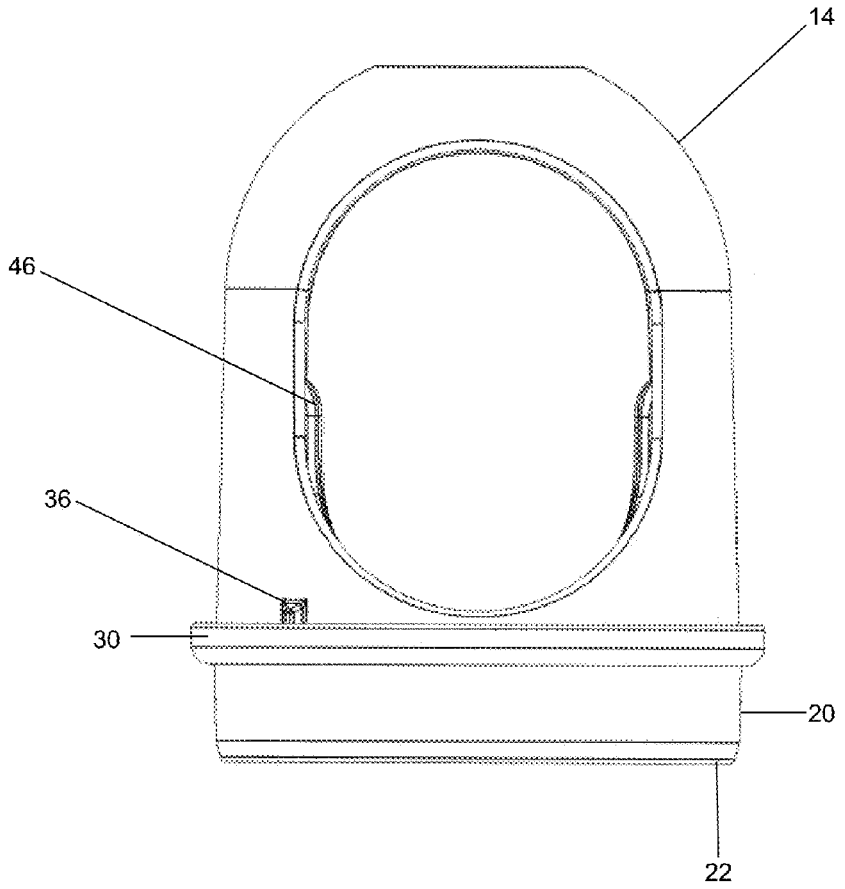
FIG. 7 is a rear view of the embodiment of FIG. 3 in the open configuration.
Figure 8:
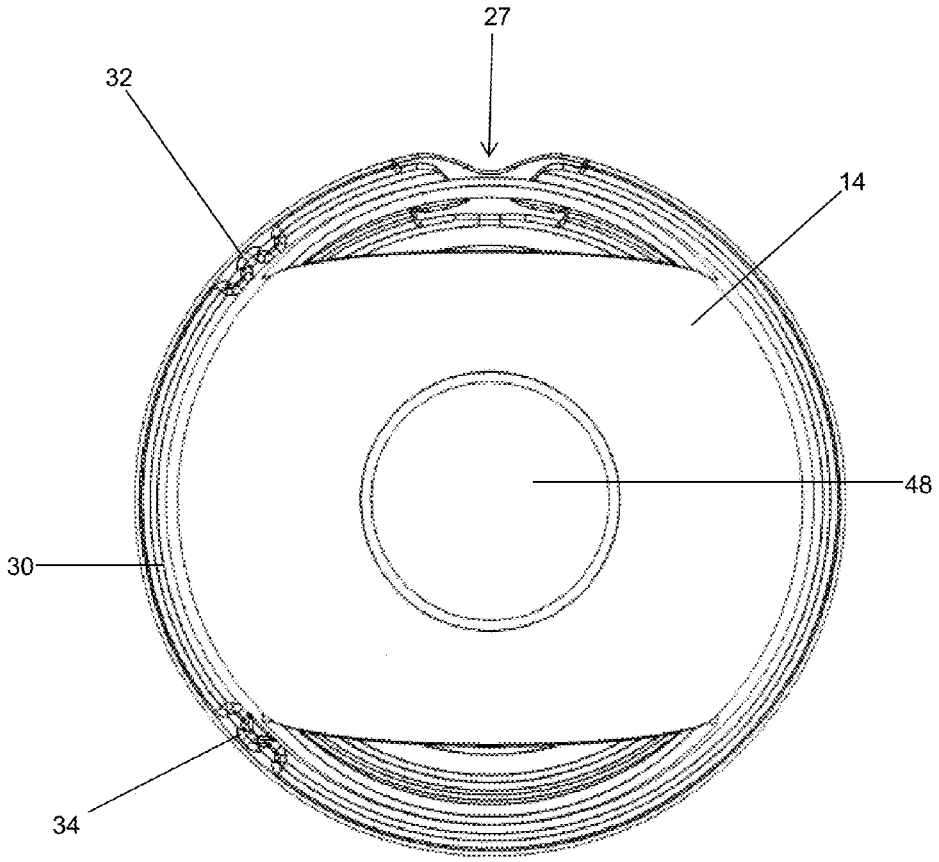
FIG. 8 is an overhead view of the embodiment of FIG. 3 in the open configuration.

FIG. 3 shows a perspective top view of the embodiment of FIG. 1 in the open configuration without the spray can. FIG. 4 is a cross-sectional front view of the embodiment of FIG. 3. In this embodiment, base 12 preferably comprises lower rim 20. Referring to FIGS. 3-14, lower rim 20 preferably comprises ridge 22, which preferably curves inward. Preferably, ridge 22 comprises a diameter slightly smaller than the outer diameter of joint 16 so that when the apparatus is installed/removed a moderate amount of force is required but base 12 does not tend to rotate about joint 16. When properly installed, ridge 22 is preferably disposed against lower external edge 24 of joint 16 and the bottom surface of seat 26 rests on top edge 28 of joint 16. See FIGS. 1-2. In a different embodiment, lower rim 20 has a diameter smaller than an outer most rolled joint of a spray can and ridge 22 projects outwardly to snap the base into place. Alternatively, lower rim 20 has a diameter larger than an outer most rolled joint of a spray can and ridge 22 curves inwardly.

Figure 15:
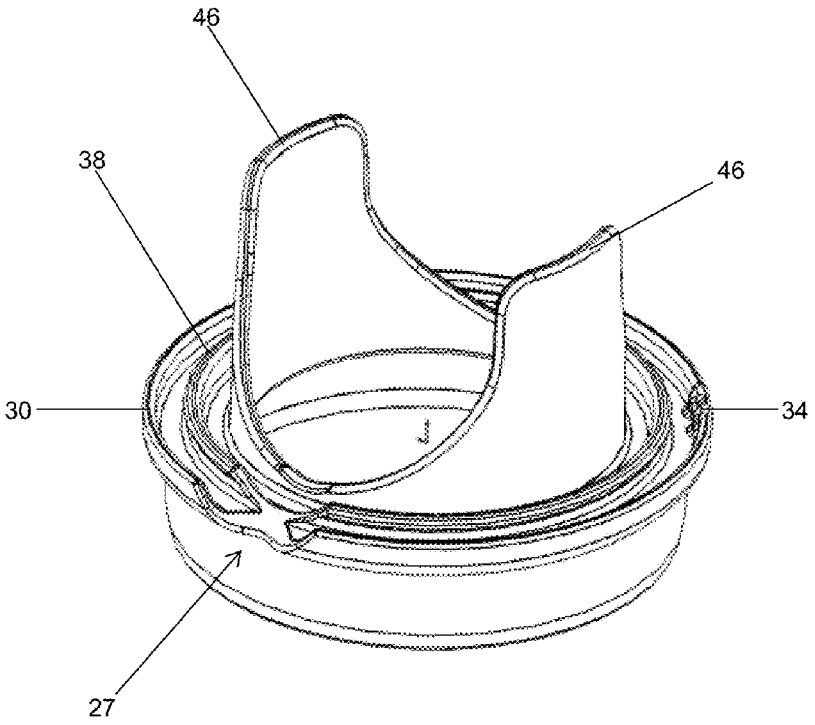
FIG. 15 is an isometric view of the base component of the embodiment of FIG. 3.
Figure 16:
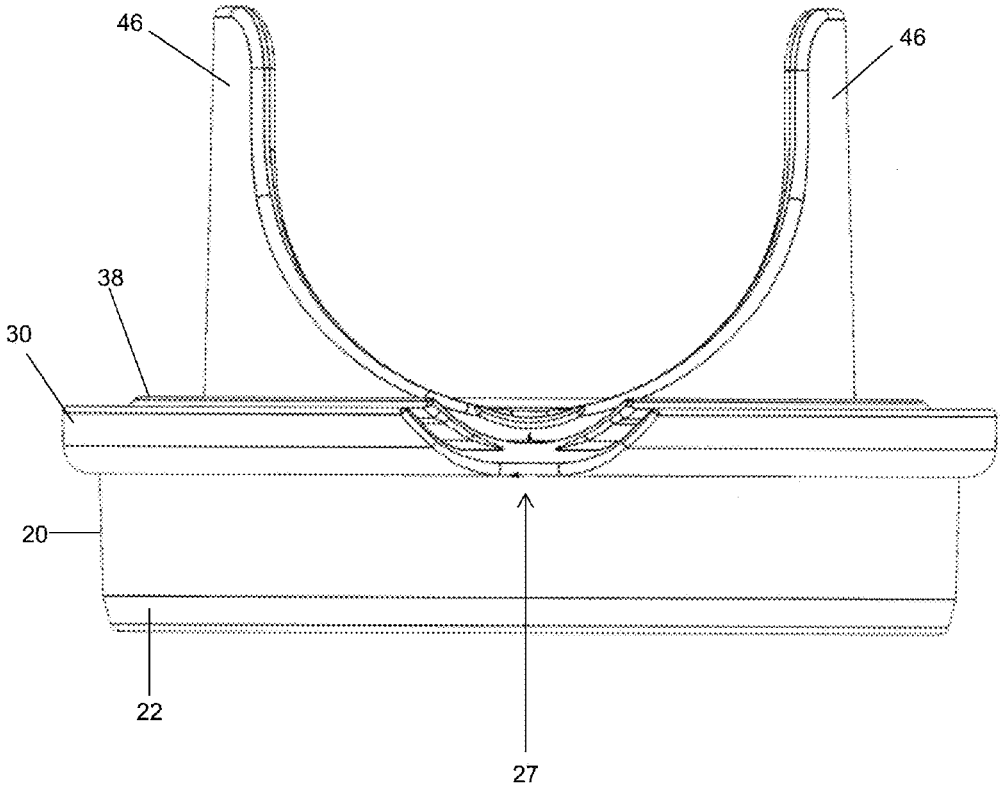
FIG. 16 is a front view of the base component of the embodiment of FIG. 3.
Figure 17A:
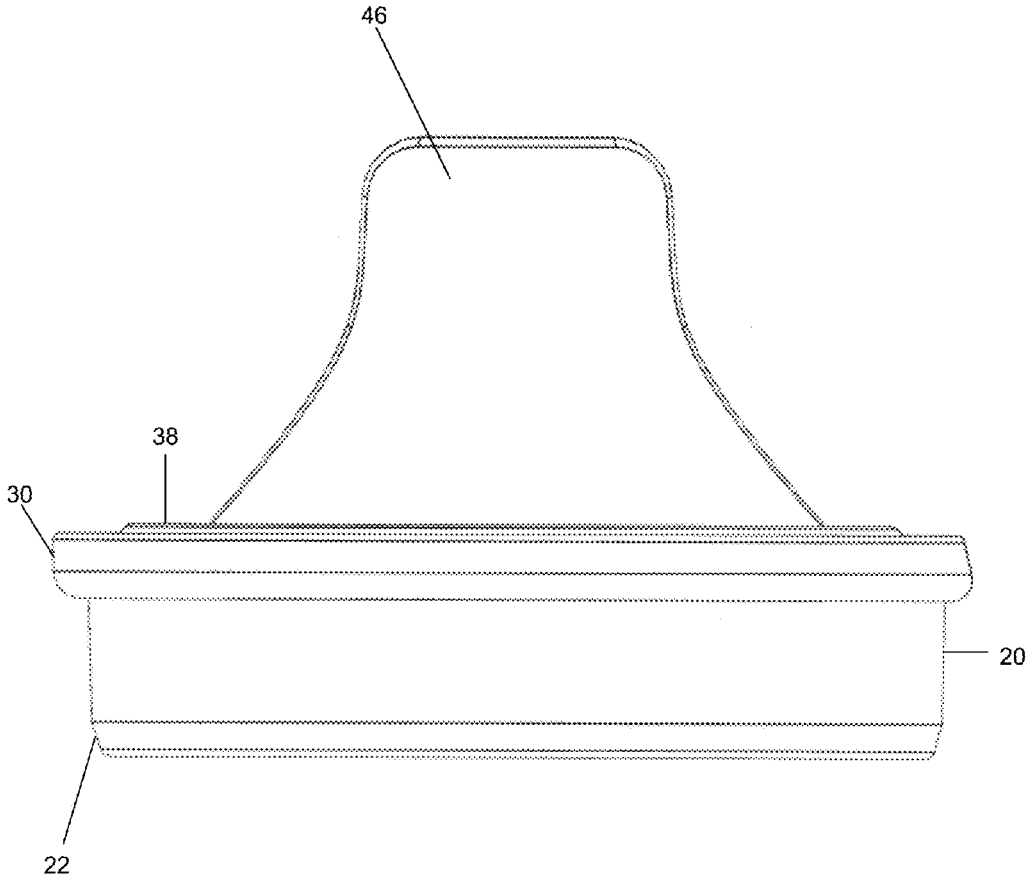
FIGS. 17A and 17B are right (A) and left (B) side views of the base component of the embodiment of FIG. 3.
Figure 17B:
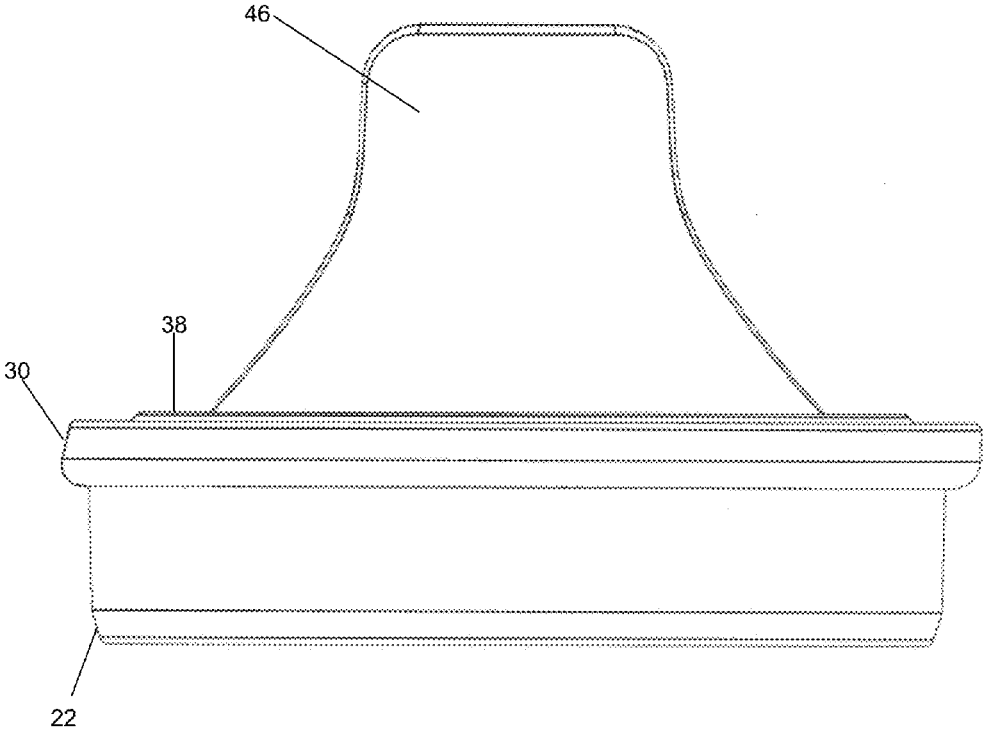
Figure 18:
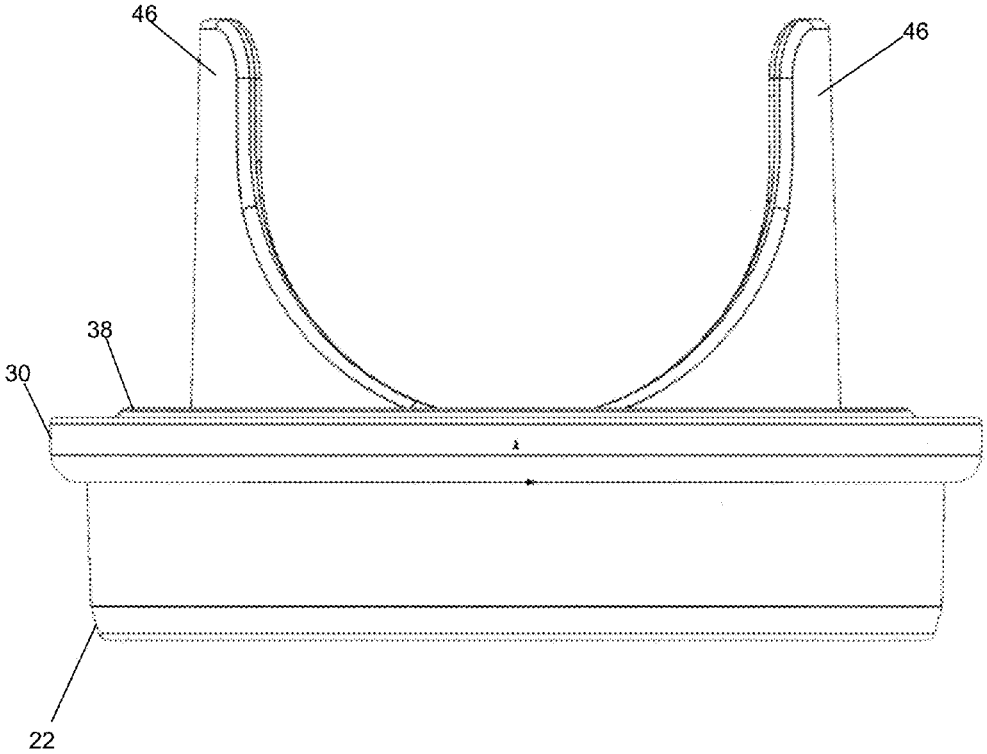
FIG. 18 is a rear view of the base component of the embodiment of FIG. 3.
Figure 19:
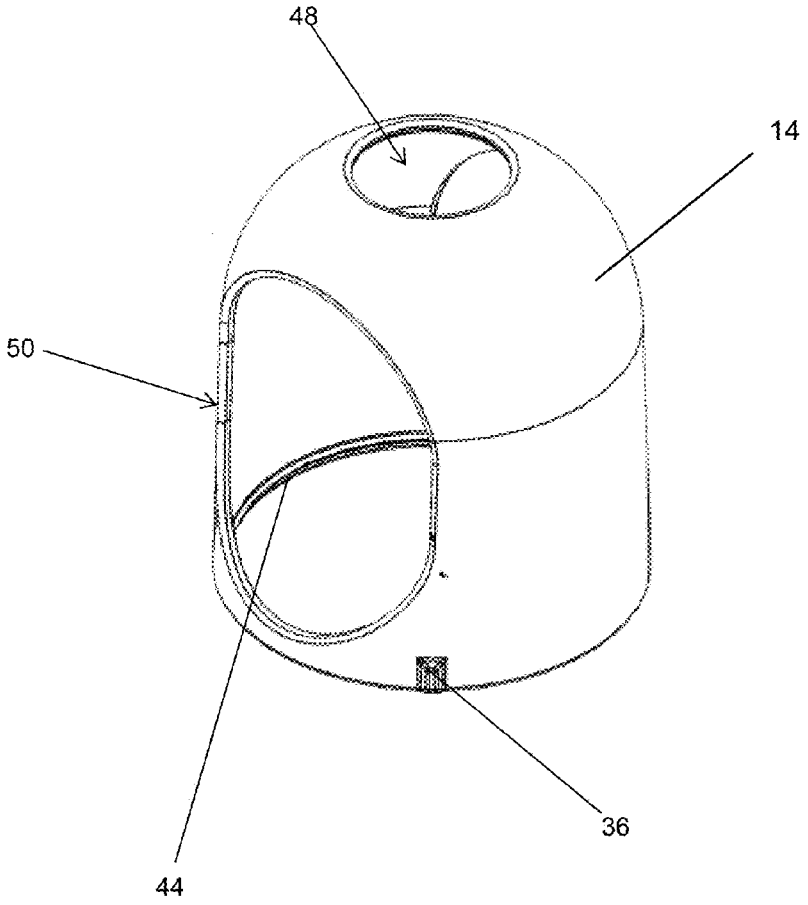
FIG. 19 is an isometric view of the shell of the embodiment of FIG. 3.
Figure 20:
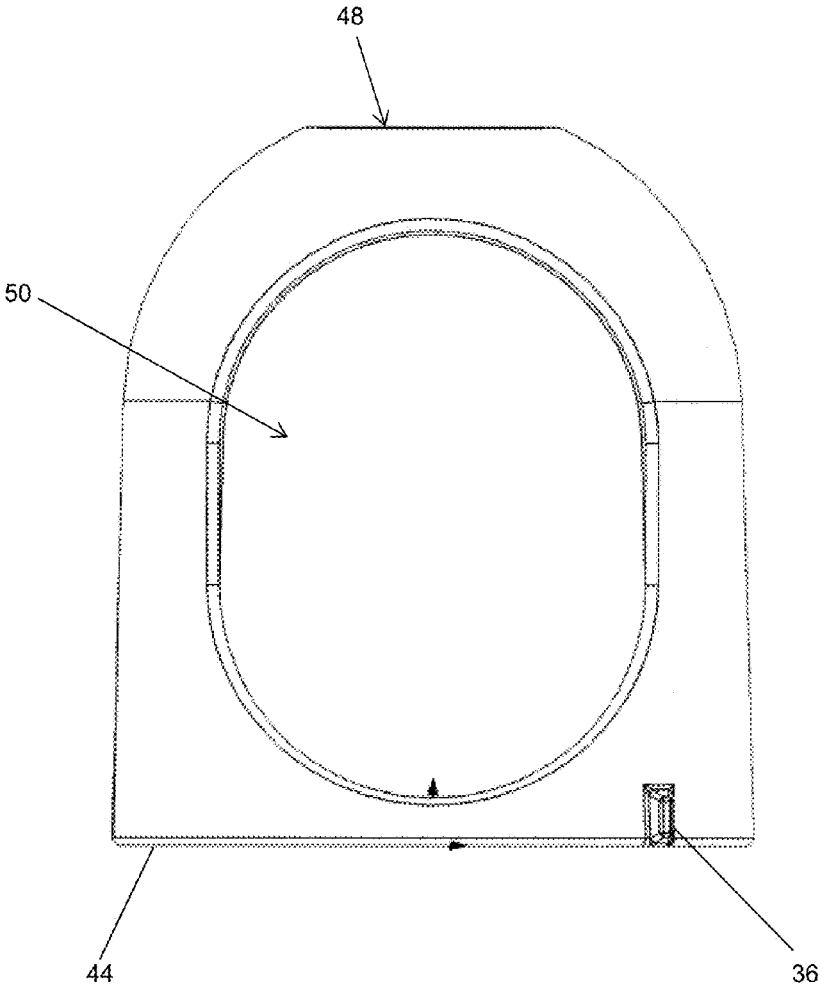
FIG. 20 is a rear view of the shell of the embodiment of FIG. 3.
Figure 21:
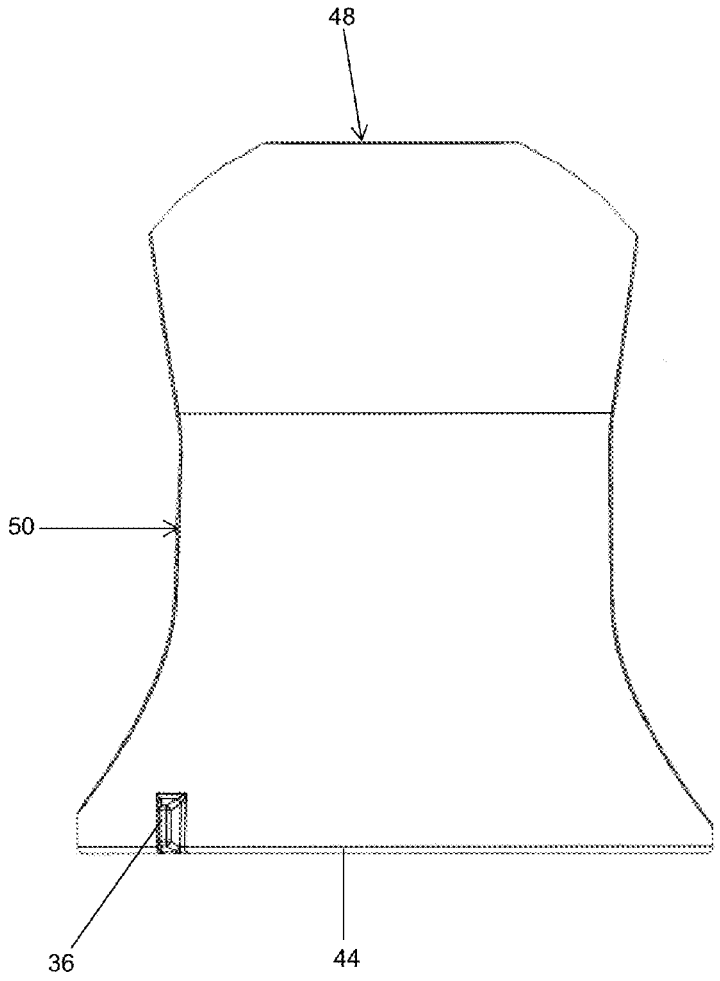
FIG. 21 is a right side view of the shell of the embodiment of FIG. 3.
Figure 22:
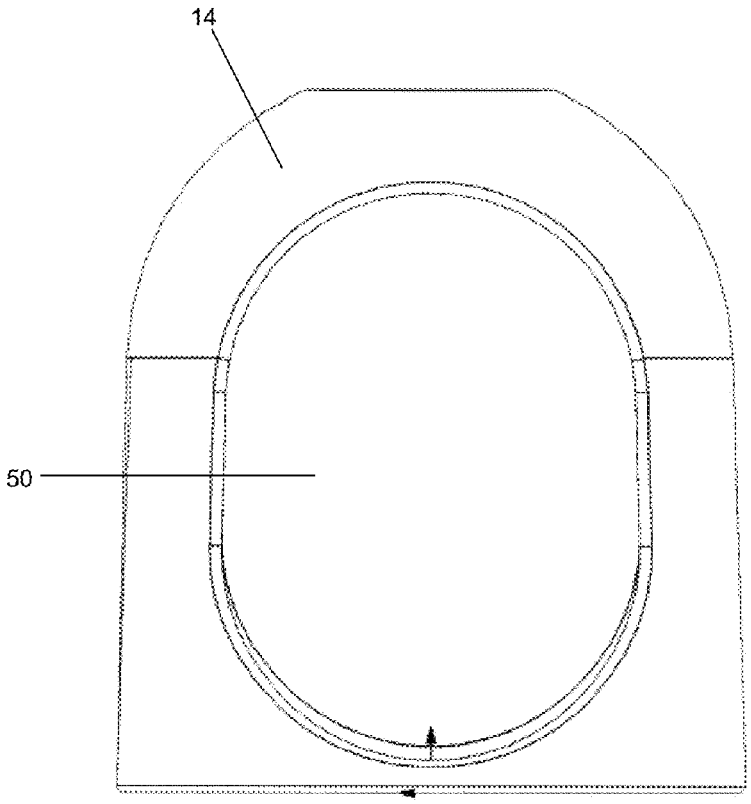
FIG. 22 is a front view of the shell of the embodiment of FIG. 3.
Figure 23:
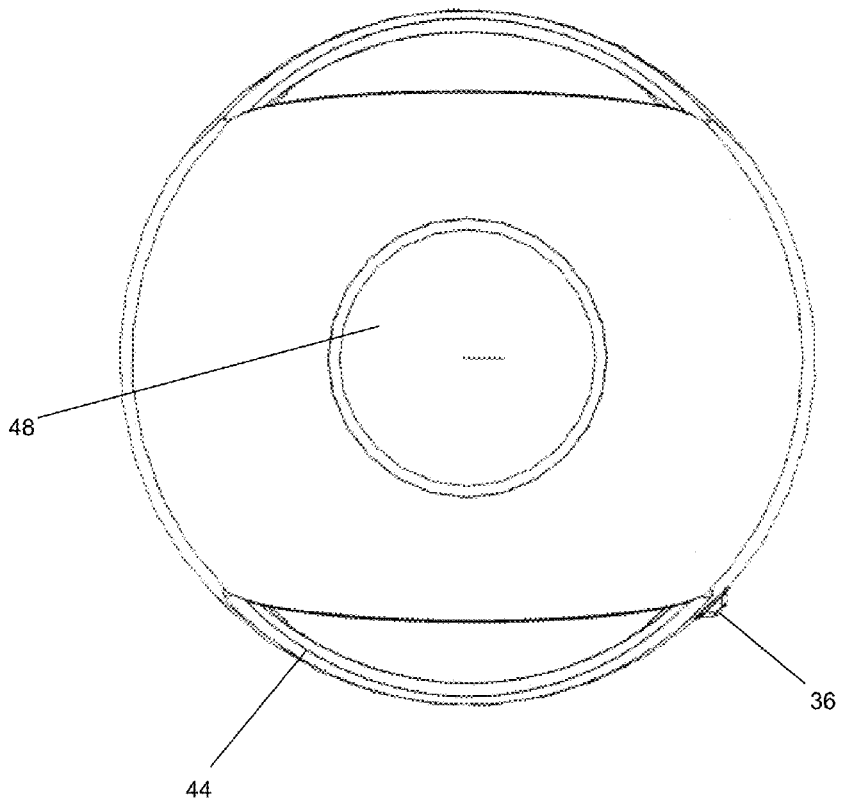
FIG. 23 is an overhead view of the shell of the embodiment of FIG. 3.
Figure 24:
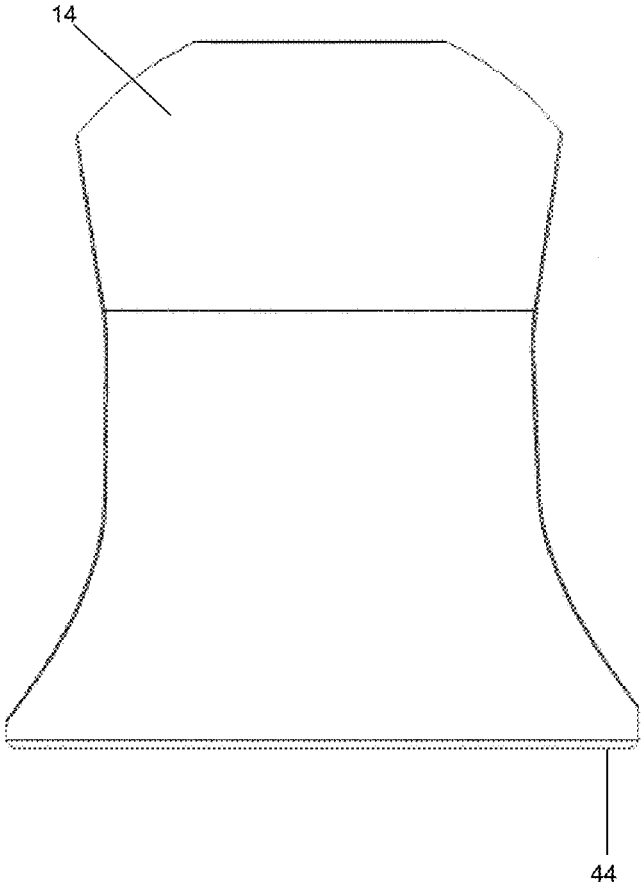
FIG. 24 is a left side view of the shell of the embodiment of FIG. 3.

Referring to FIGS. 3-19, on its opposite side (top), seat 26 preferably comprises a plurality of concentric cylindrical projections. In one embodiment one of these projections is preferably outer detent rim 30 (see FIGS. 4, 15), which is preferably relatively short in height and on its inner periphery comprises one or more vertical ridges protruding inwardly, optionally at approximately 90 degrees relative to the vertical axis of detent rim 30 to serve as detents. In one embodiment detent rim 30 comprises open/close detents 32, 34 (FIG. 14), which preferably interlock with one or more ridges 36 (FIG. 19) protruding from the lower outer periphery of shell 14 to hold the shell in either an open or closed configuration.

Preferably, seat 26 further comprises a second upward projection 38 (FIG. 15), concentric to detent rim 30 and disposed inwardly in relation to it. Preferably, projection 38 comprises outward protruding ridge 40 relatively close to its top edge. Ridge 40 preferably interlocks with ridge 44 of similar proportions disposed at the lower inner periphery of shell 14 to hold the shell in place while allowing it to revolve about. Optionally, sections of projection 38 are removed, for example, to facilitate removal from an injection mold or to fine tune the tension exerted upon shell 14 during impact to permit it to dislodge without exerting enough tension upon base 12 to dislodge base 12.

Figure 9:
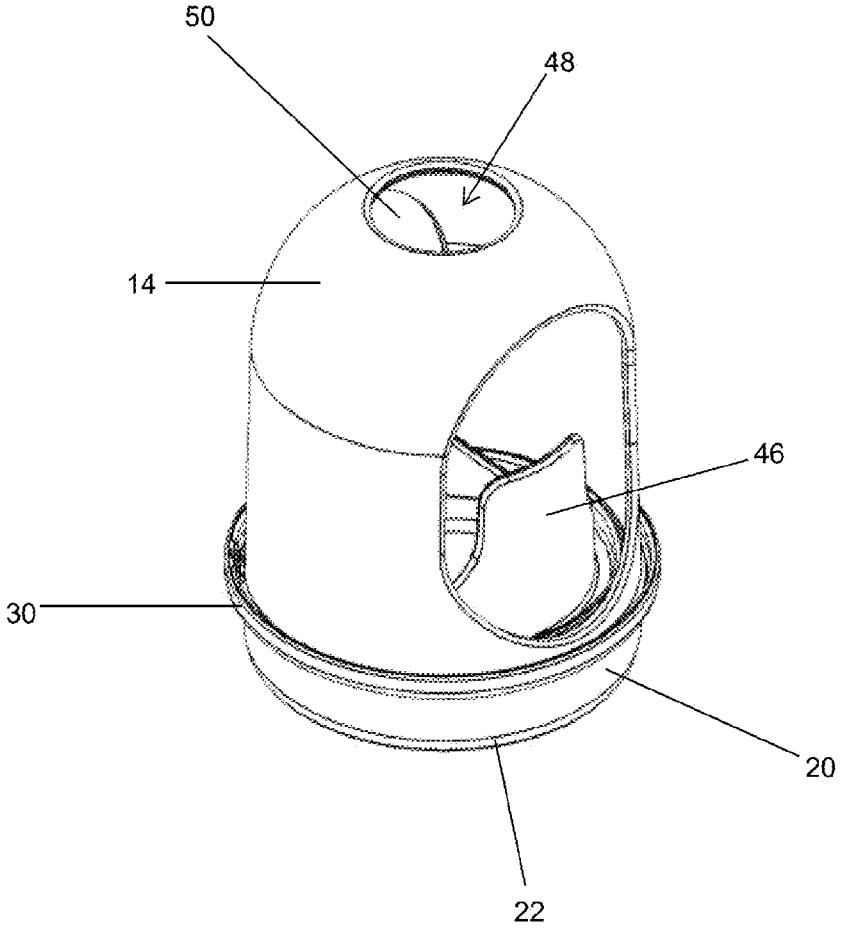
FIG. 9 is an isometric view of the embodiment of FIG. 3 in the closed configuration.
Figure 10:
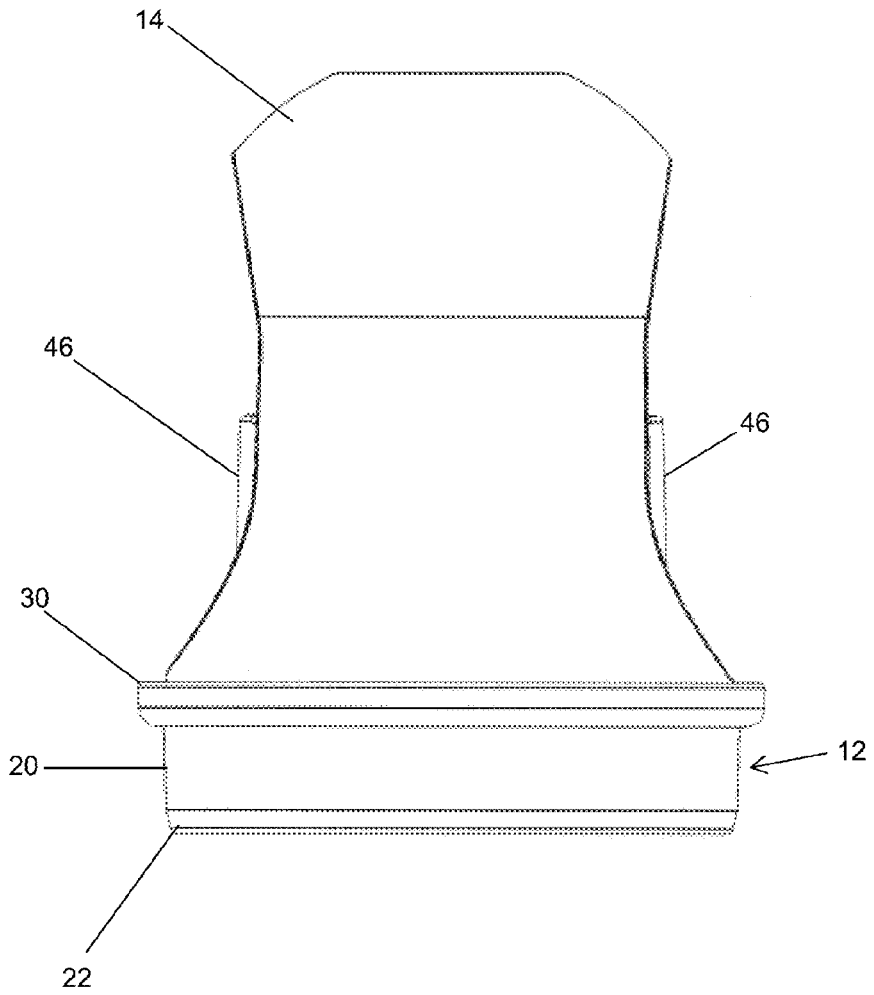
FIG. 10 is a rear view of the embodiment of FIG. 3 in the closed configuration.
Figure 11:
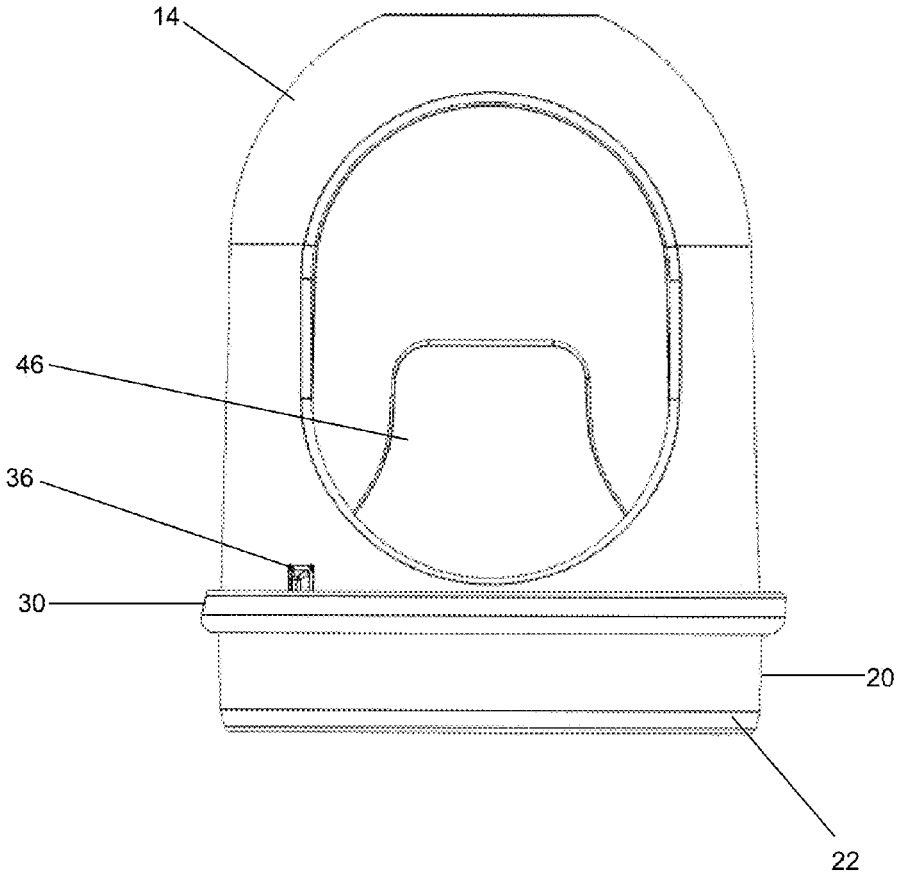
FIG. 11 is a left view of the embodiment of FIG. 3 in the closed configuration.
Figure 12:
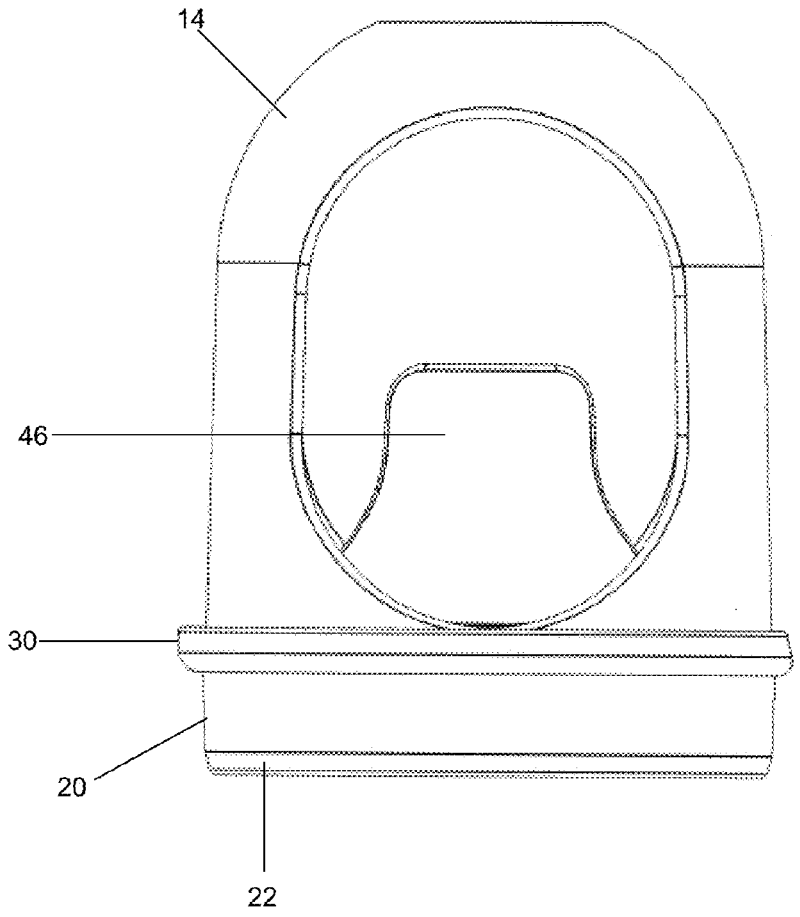
FIG. 12 is a right view of the embodiment of FIG. 3 in the closed configuration.
Figure 13:
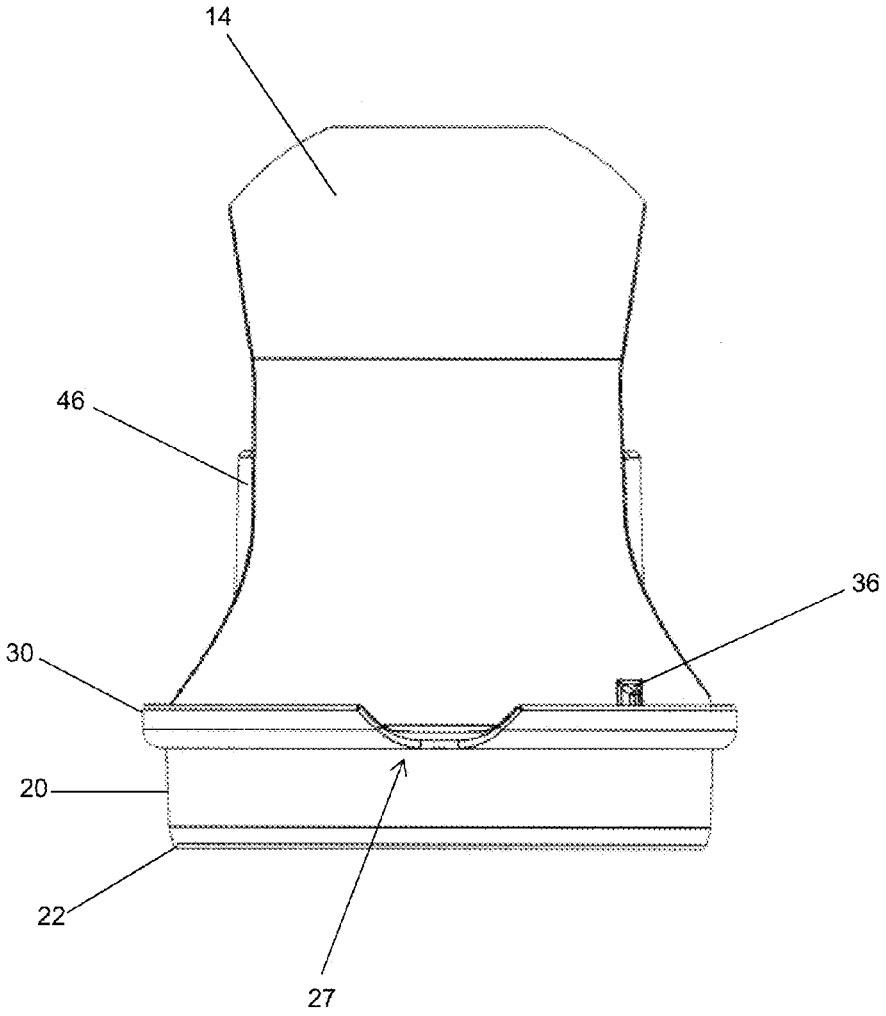
FIG. 13 is a front view of the embodiment of FIG. 3 in the closed configuration.
Figure 14:
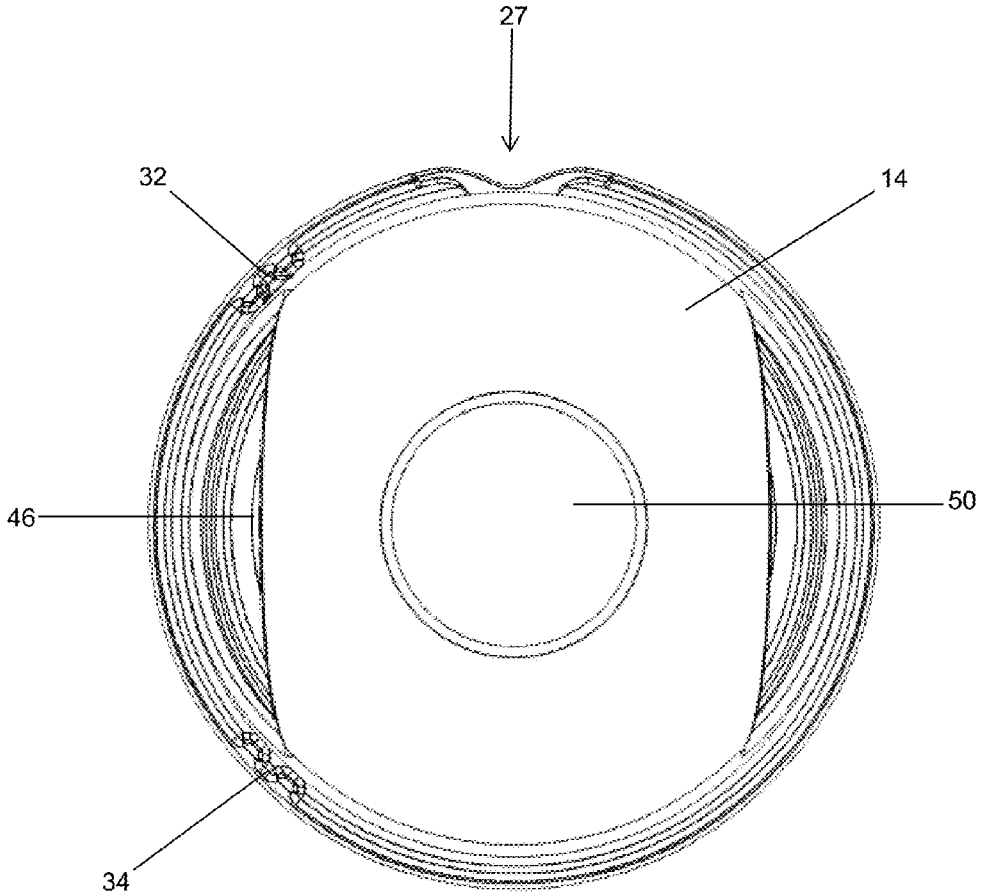
FIG. 14 is an overhead view of the embodiment of FIG. 3 in the closed configuration.

Preferably, seat 26 further comprises a third upward projection 42, concentric to the other two projections and disposed inwardly in relation to them. Preferably projection 42 comprises two deflector walls 46, which are formed by, for example, cutting two arcs diametrically opposed to each other. Optionally, the tops of deflector walls 46 are clipped, molded, or otherwise sized to a height about or just above the height of most common nozzle actuator buttons and provide sufficient clearance for the spray path to flow uninterrupted and the user's finger to access nozzle actuator button 13. The inner face of projection 42 is preferably flush with the inner end of seat 26 (FIG. 4), which approximates, in turn, the inner most diameter of seal 16. In one embodiment, deflector walls 46 are preferably built to protect the nozzle actuator assembly during secondary impacts, e.g., when shell 14 is dislodged during a primary impact and/or to shield the nozzle actuator assembly when shell 14 is rotated into the closed configuration (FIG. 9).

Optionally, shell 14 is easily removed by the user in instances when the spray pattern needs to be greater than that allowed when shell 14 is in place. In that case, base 12 can be used alone and still provide protection for the nozzle actuator assembly when such clearance is necessary because walls 46, which are part of base 12, are capable of deflecting impacts. Optionally the projections protruding upward from seat 26 are carved out at the front end of base 12 (indentation 27) to decrease interference with the spray pattern (see e.g., FIGS. 6, 8, 16, and 26).

Referring to FIGS. 19-24, shell 14 is preferably a single piece component comprising a relatively small, centrally disposed, optional hole 48 at its top end and two openings 50, preferably oval in shape, at its front and back ends wherein the size and shape is sufficiently large to accommodate the finger of a user moving in and out to access the nozzle actuator button and permit unobstructed flow of the contents of the can when sprayed. As discussed above, the lower inner face of shell 14 comprises inward facing ridge 44. In one embodiment, ridge 44 is segmented to facilitate installation/removal from base 12. Ridge 44 preferably snaps onto projection's 38 outward protruding ridge 40 during installation allowing shell 14 to revolve around a vertical axis.

Figure 28A:
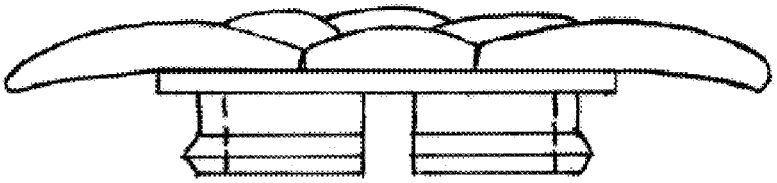
FIGS. 28A and 28B are a cross-sectional view and a top view of an example of a possible insert accessory for the sell.
Figure 28B:
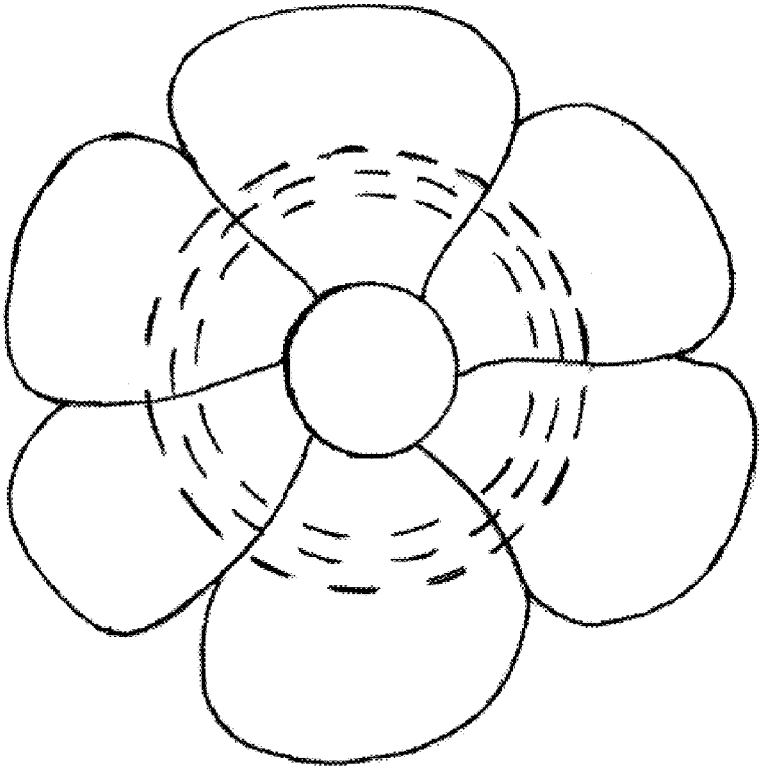

Decorative elements may be attached to the shell, for example, at hole 48. Preferably, such elements are made from a resilient material and/or do not fill hole 48 so that its ability to collapse during an impact is not disrupted. For example, a decorative element such as the one illustrated in FIGS. 28A and 28B fits in hole 48. Many variations of the shell's design are possible as long as all they work similarly. The shell which has attached to it another piece or pieces which rotate, flap, slide, or otherwise work to cover the openings must take all of these factors into account. A decorative element may alternatively be integrally formed with shell 14.

Figure 25:
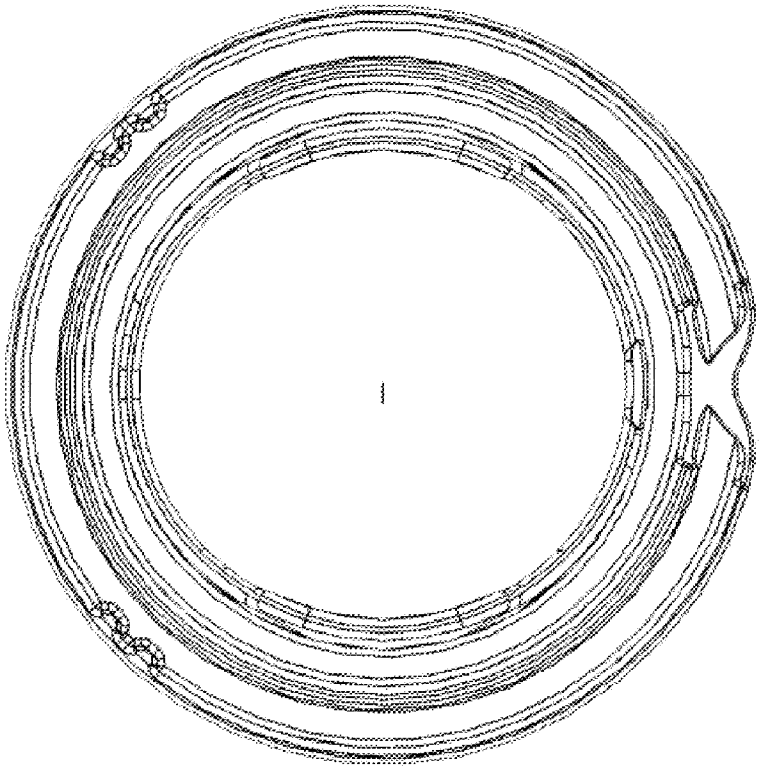
FIG. 25 is an overhead view of an alternate embodiment of the base showing detents in a different position.
Figure 26:
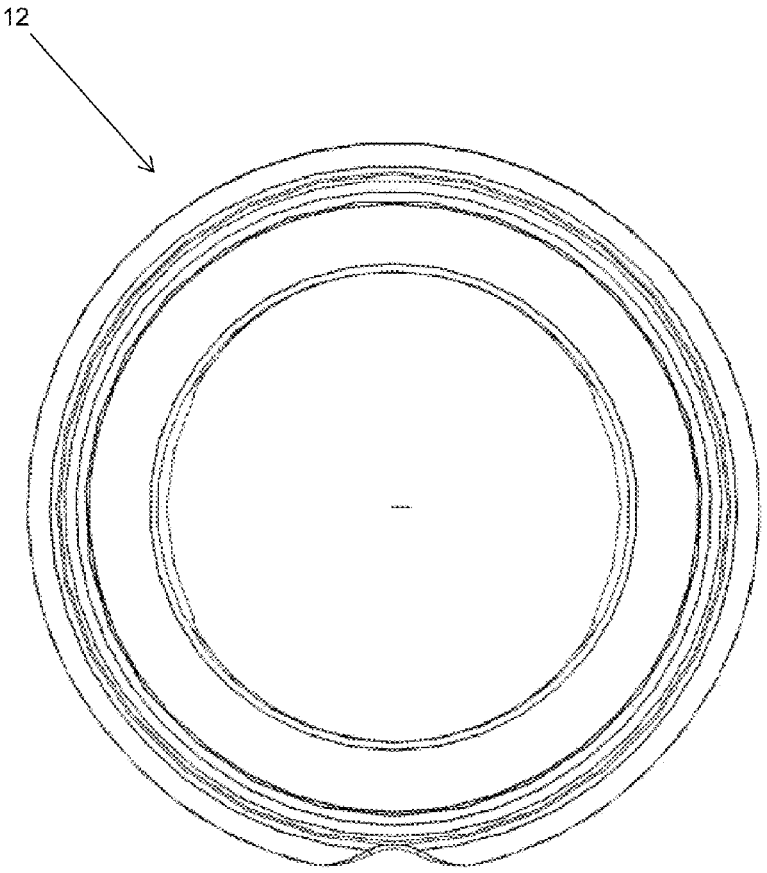
FIG. 26 is a bottom view of base component of the embodiment of FIG. 3.
Figure 27:
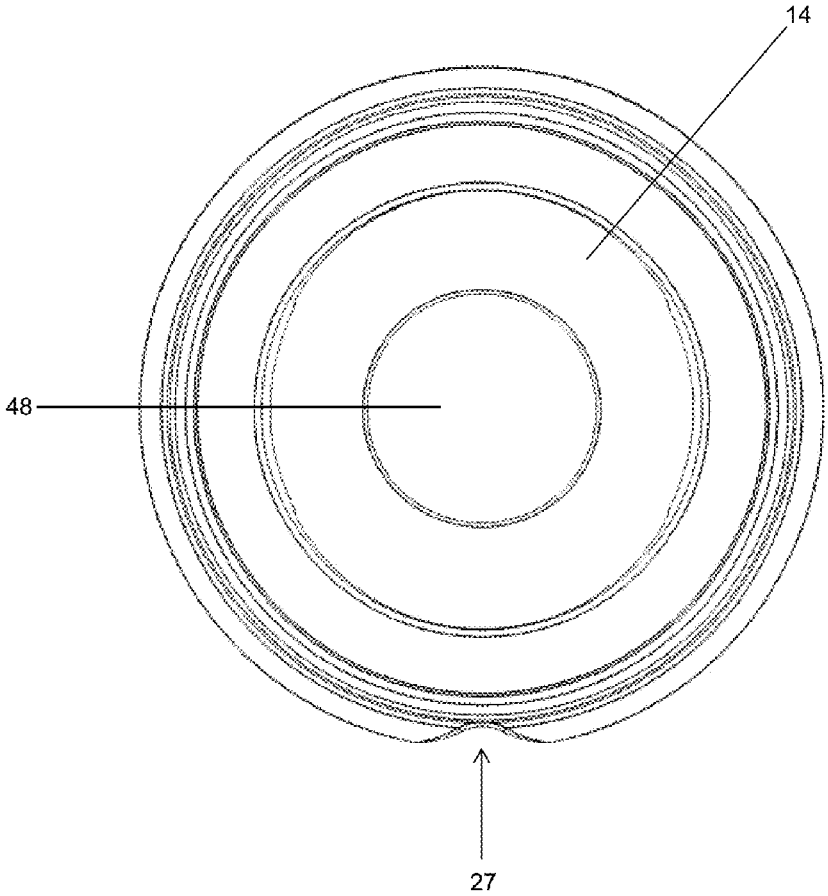
FIG. 27 is a bottom view of assembly of the embodiment of FIG. 3.

FIG. 25 shows an alternative embodiment of base 12 comprising, for example, segmentations and alternative locations for detent ridges.

Figure 29:
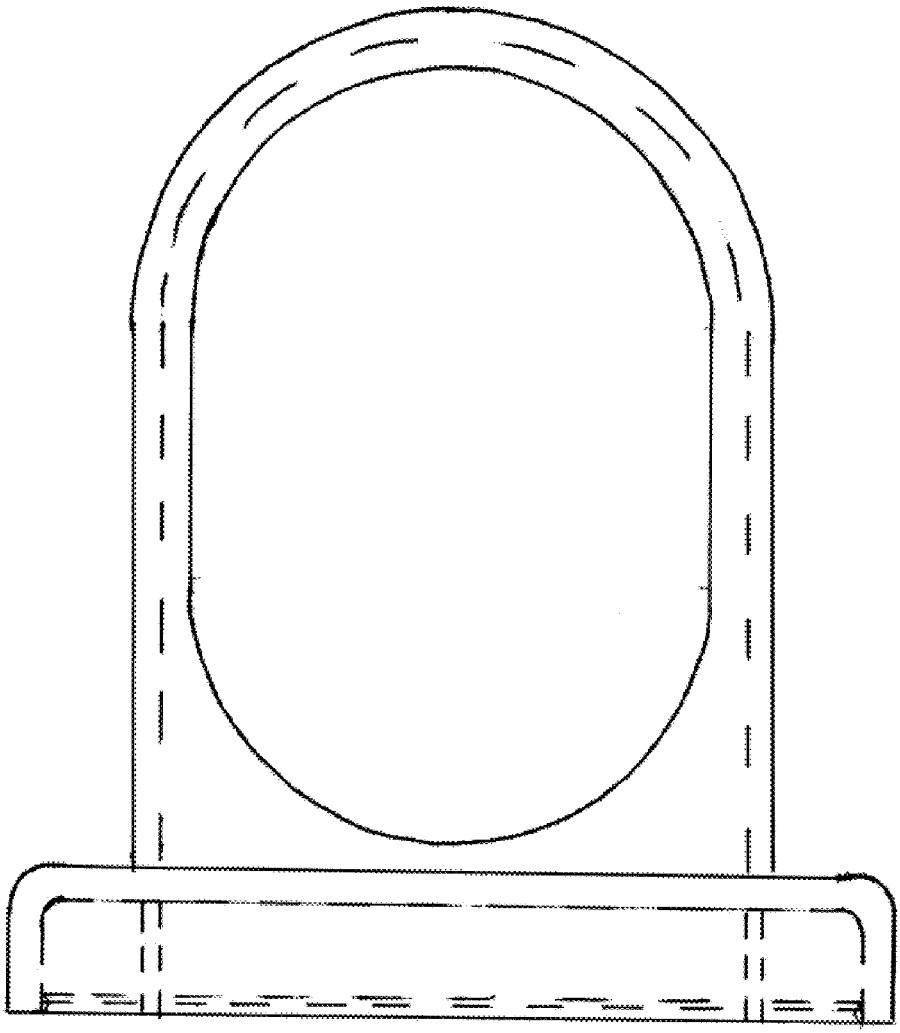
FIG. 29 is a cross-sectional view of an embodiment of a single piece apparatus.
Figure 30:
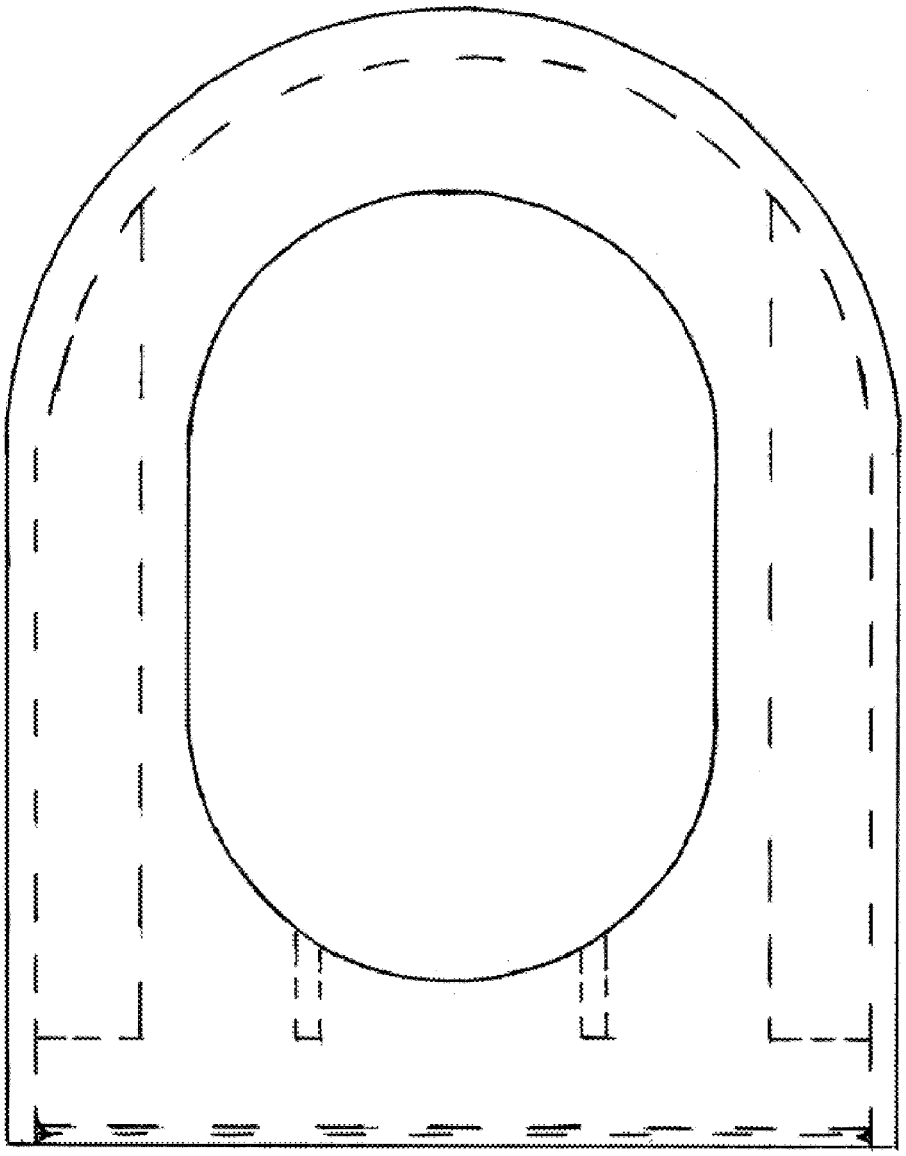
FIG. 30 is a cross-sectional view of a different embodiment of a single piece apparatus.
Figure 31:
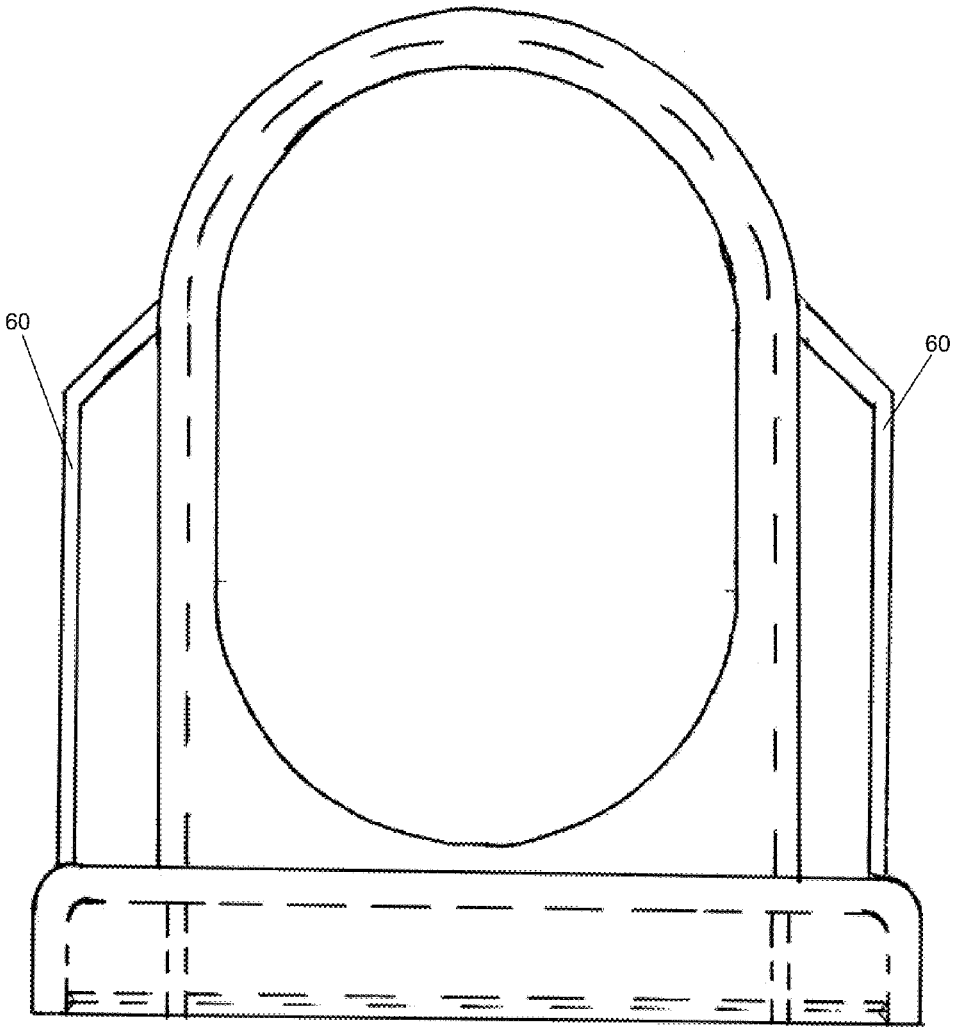
FIG. 31 is a cross-sectional view of a different embodiment of a single piece apparatus.

FIGS. 29, 30, and 31 show cross-sectional views of embodiments of single piece protectors (i.e., base and shell are fused) with optional reinforcement elements illustrated in ghost lines. These embodiments preferably fit over and snap onto sealed joint 16. The embodiment of FIG. 31 further comprises wing structures 60 on the sides of the shell for reinforcement against impacts.

Figure 32:
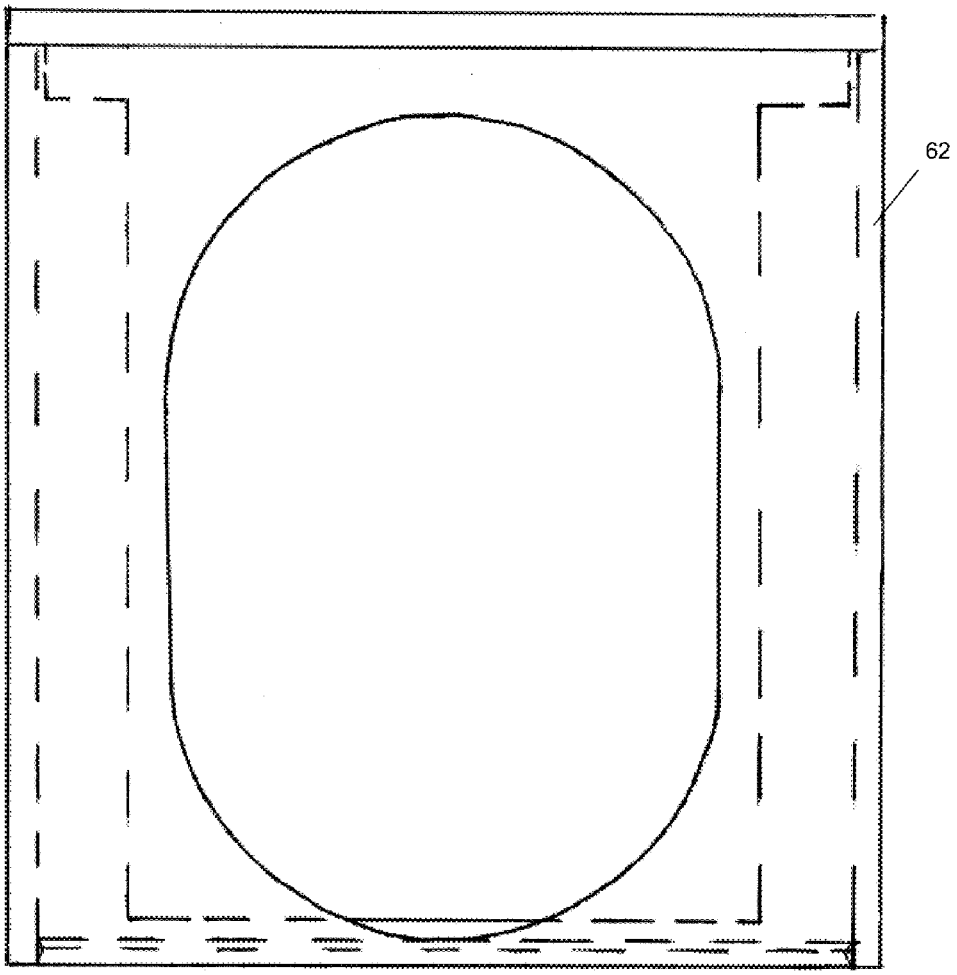
FIG. 32 is a cross-sectional view of a different embodiment of a single piece apparatus
Figure 33:
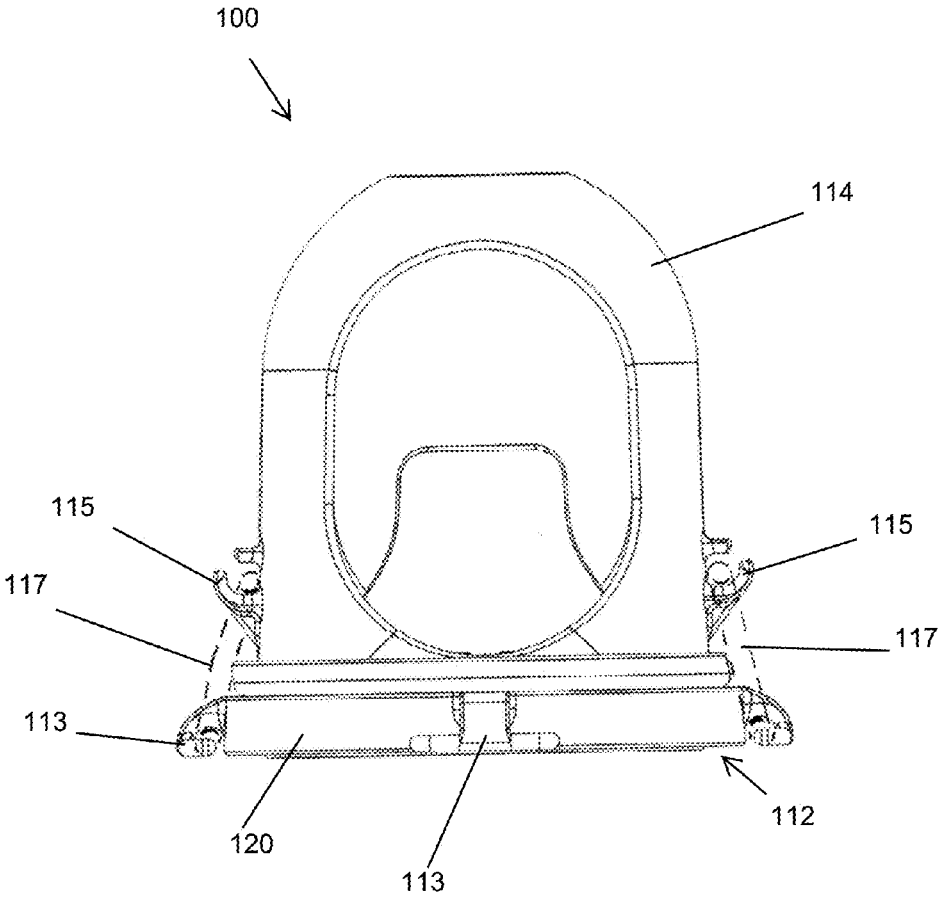
FIG. 33 is a front view of a different embodiment of the invention.
Figure 34:
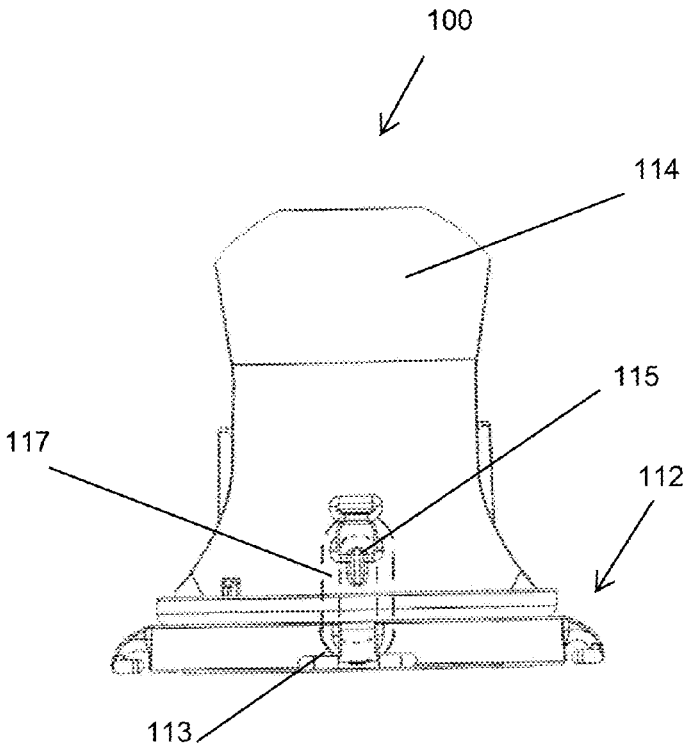
FIG. 34 is a right side view of the embodiment of FIG. 33.
Figure 35:
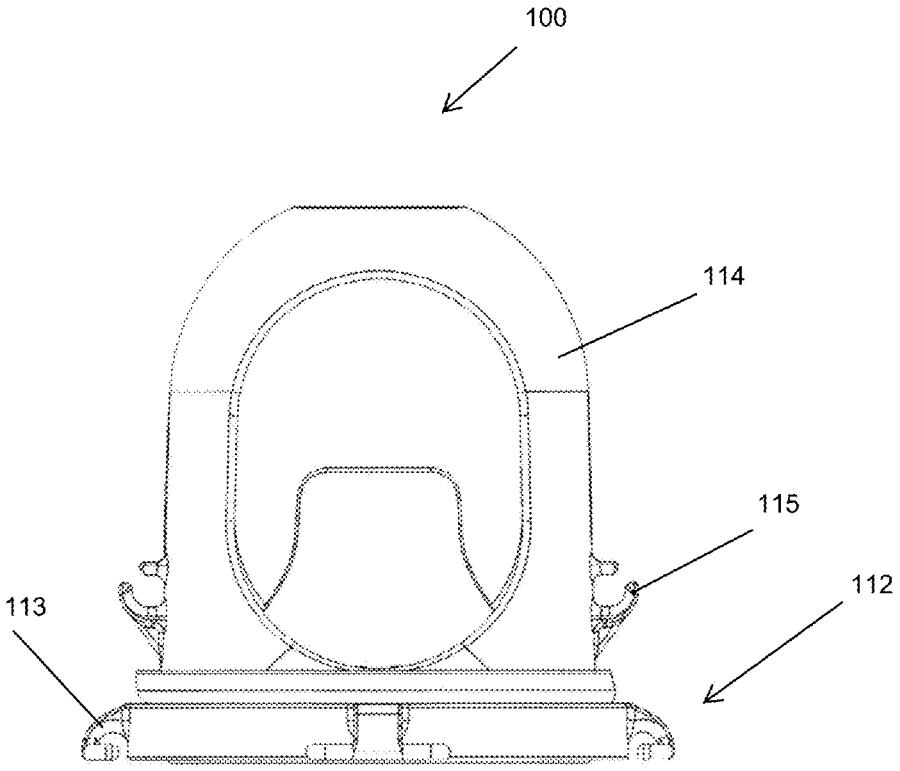
FIG. 35 is a back view of the embodiment of FIG. 33.
Figure 36:
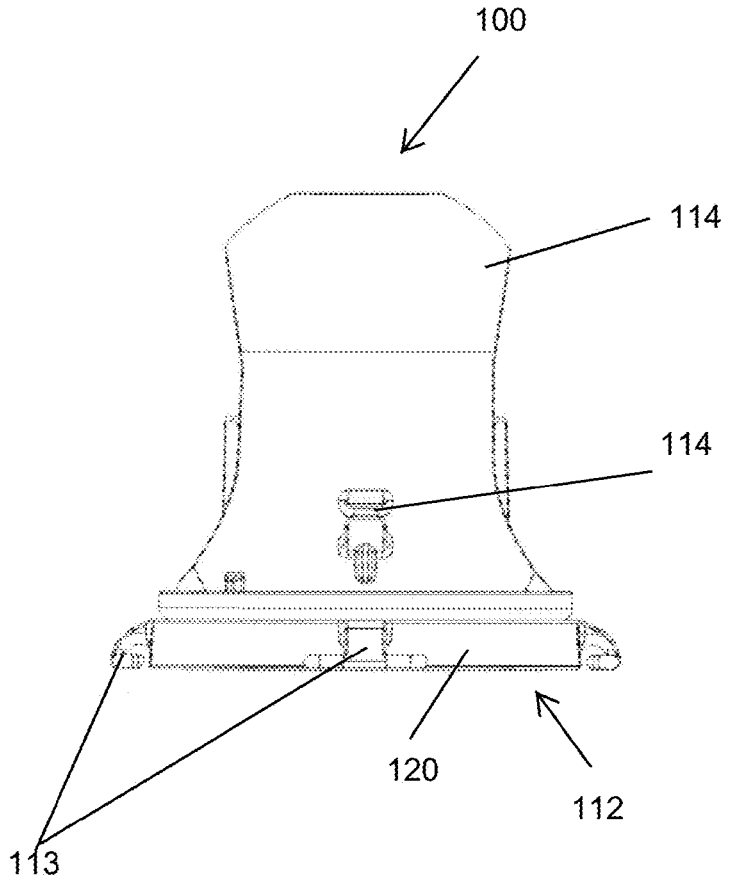
FIG. 36 is a left side view of the embodiment of FIG. 33.
Figure 37:
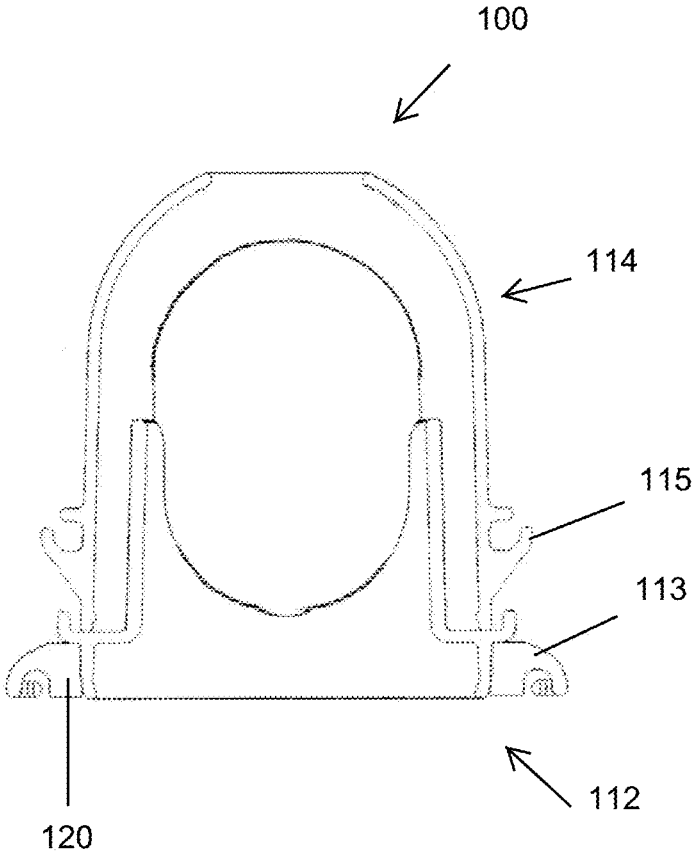
FIG. 37 is a cross-sectional side view of the embodiment of FIG. 33.
Figure 38:
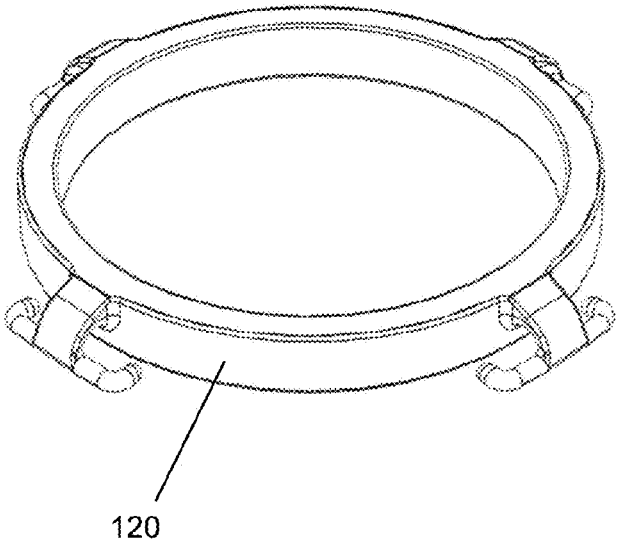
FIG. 38 is a perspective view of a detachable component of the base of the embodiment of FIG. 33.
Figure 39:
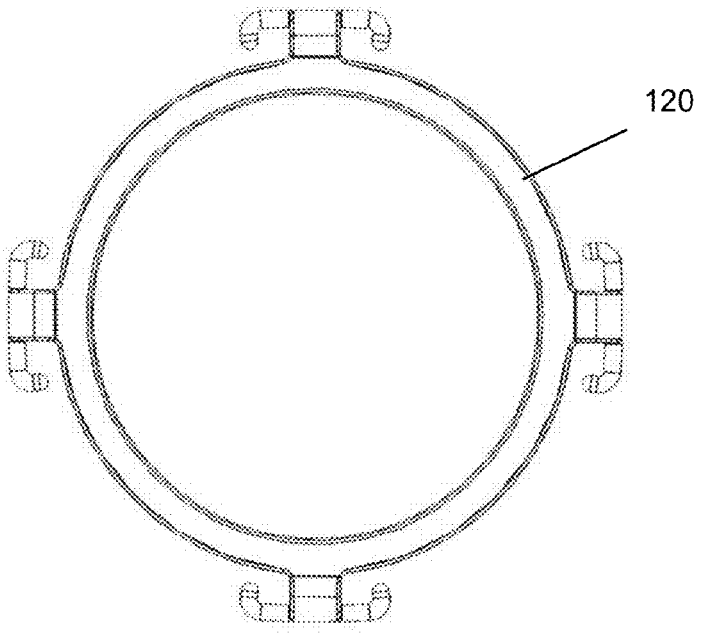
FIG. 39 is a top view of the component of FIG. 38.
Figure 40:
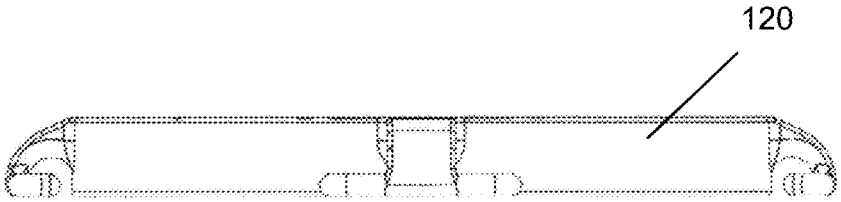
FIG. 40 is a front view of the component of FIG. 38.
Figure 41:
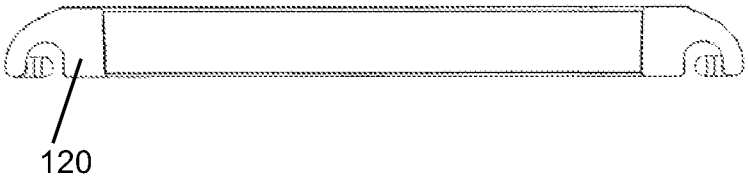
FIG. 41 is a cross-sectional side view of the component of FIG. 38.
Figure 42:
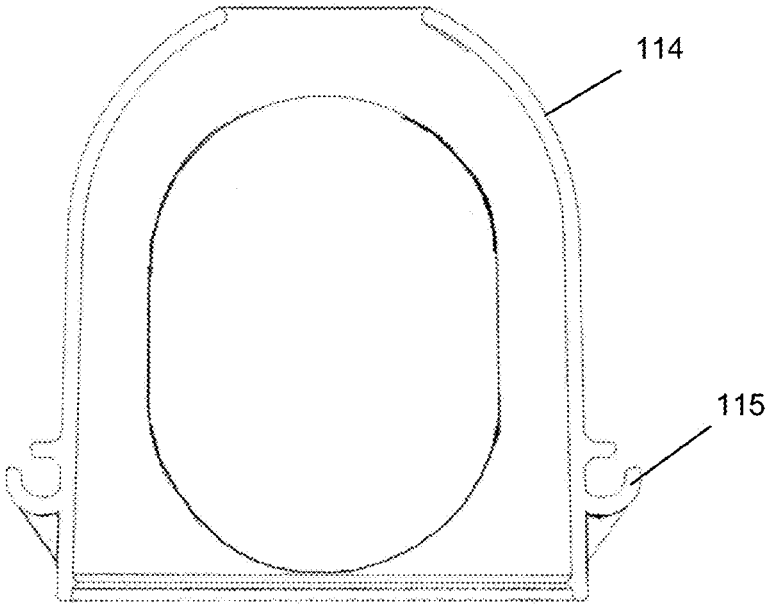
FIG. 42 is a cross-sectional side view of the shell of the embodiment of FIG. 33.

FIG. 32 shows a cross-sectional view of a different embodiment of a nozzle actuator assembly protector comprising an outer shell component 62 (delineated with ghost lines) that revolves to provide open and closed configurations and preferably fits over and snaps onto sealed joint 16.

In one embodiment, hole 48 is not provided. In another embodiment, shell 14 is not provided. In another embodiment, detent rim 30 is not provided. In a different embodiment, deflector walls 46 are not provided. In another embodiment, indentation 27 is not provided.

Figure 49:
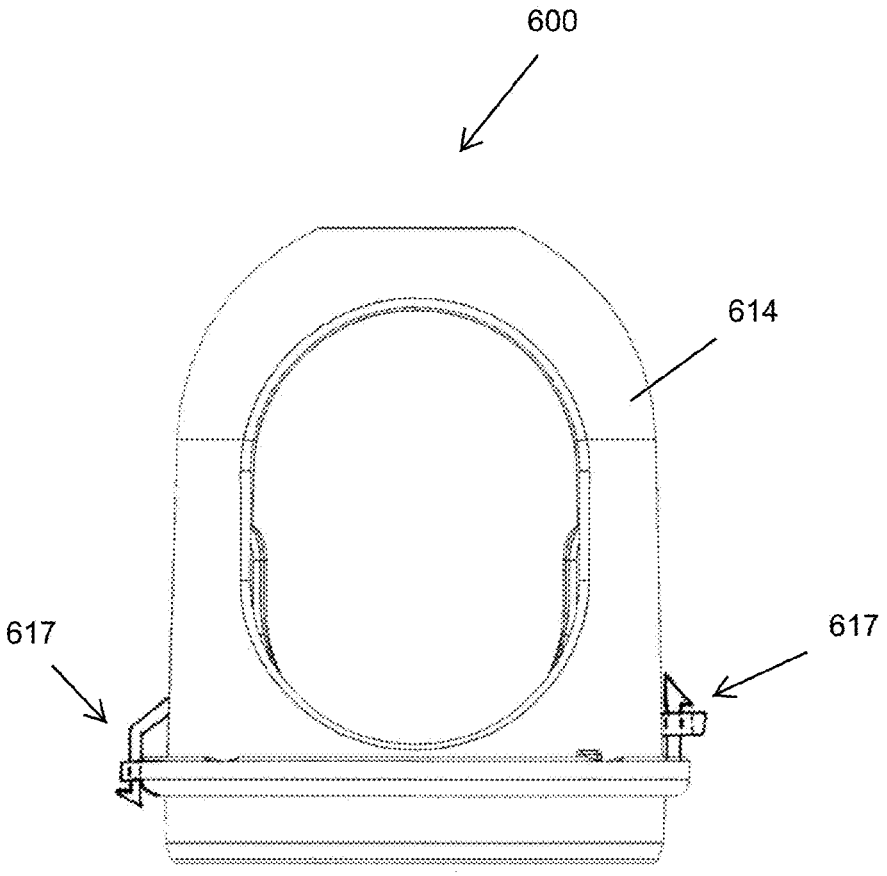
FIG. 49 is a front view of a different embodiment of the invention in which the shell component can attach to the base component through hook and loop elements.

Referring now to FIGS. 33-42, there is shown nozzle protector 100 preferably comprising base component 112, which comprises one or more base hooks 113, and shell component 114, which comprises one or more shell hooks 115. Preferably, base hooks 113 and shell hooks 115 allow a restraint, for example, an O-ring 117 (shown in ghost lines in FIGS. 33-34), to further secure a connection between base component 112 and shell component 114. Preferably the restraint helps to position and prevent shell 114 from accidentally separating from the protector, and to lessen the effect of the forces acting to remove the base from the can during angled drops and bumps. These restraints can be, but are not limited to, any type of elastic type o-ring, band, strap, coil spring, or molded in component, such as a hook and loop (see e.g., FIG. 49), whose composition, mounting, and dimensions can be varied to give the desired results, with the restraint being either permanently deformed after a drop or re-useable. In the case of an O-ring, preferably it is made of a stretchy material in a size that preferably allows a user to dispose over base hooks 113 and shell hooks 115 with ease. Optionally, lower rim component 120 is detachable from base 112. See FIGS. 38-41.

Figure 43:
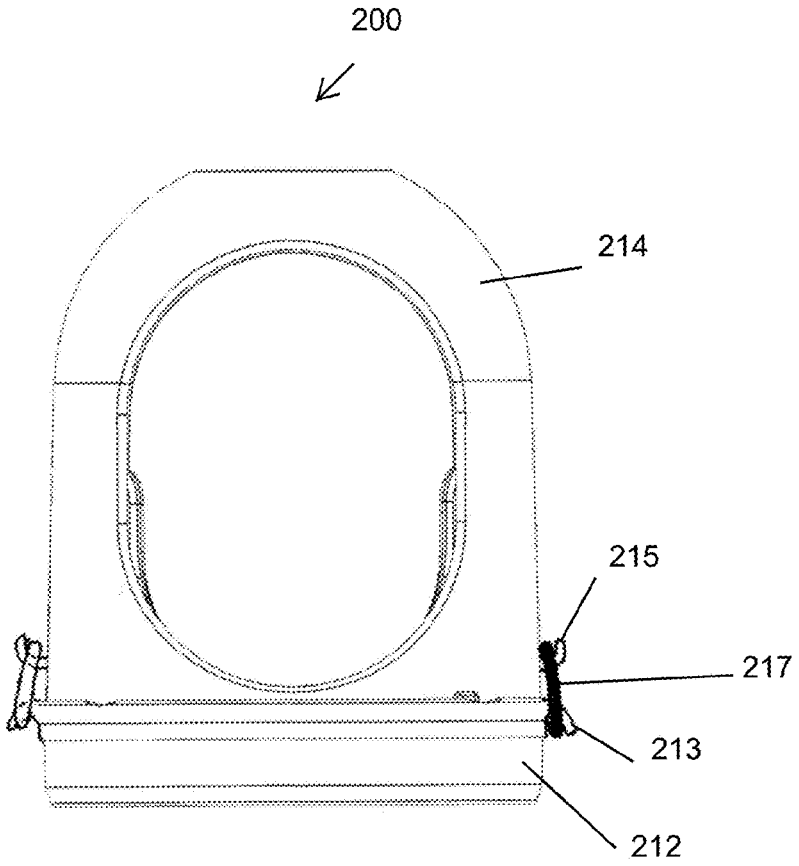
FIG. 43 is a front view of a different embodiment of the invention comprising different attachments for restraints.

Referring to FIG. 43, there is shown a different embodiment of the invention wherein nozzle assembly protector 200 comprises base 212 and rotating shell 214. Preferably, base 212 comprises hooks 213 and rotating shell 214 comprises hooks 215 that preferably line up with each other when rotating shell 214 is set to an open configuration so that a restraint can be employed, for example, O-ring 217.

Figure 44:
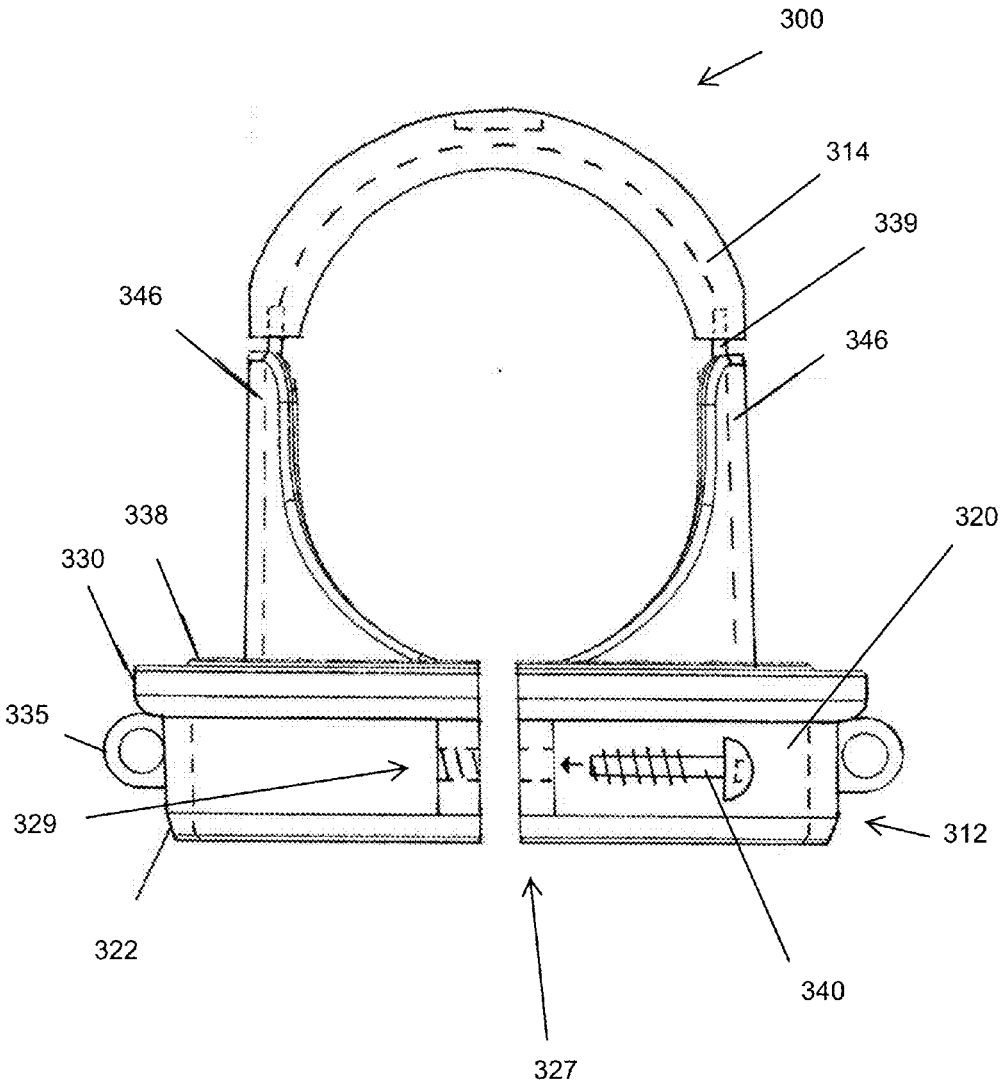
FIG. 44 is a front view of a different embodiment of the invention comprising a clamp attachment mechanism on the base component of the apparatus and holding rings.
Figure 45:
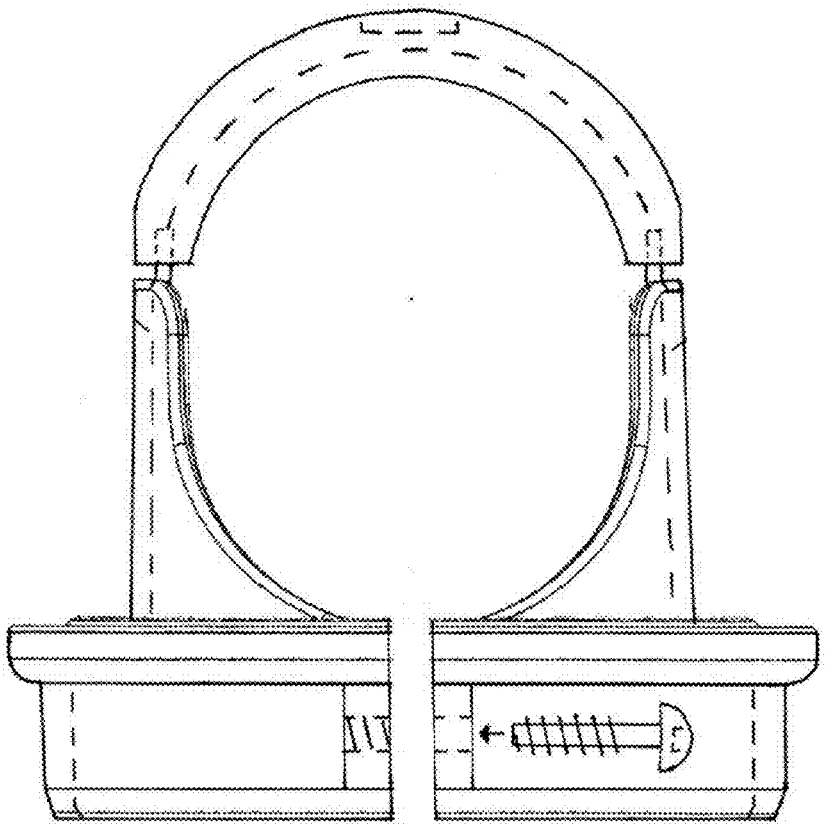
FIG. 45 is a front view of an embodiment similar to that of FIG. 44 but without holing rings.

Referring to FIG. 44, in a different embodiment, nozzle assembly protector 300 comprises clamp assembly 327 in which base 312 is, for example, split to slip over a spray can's rolled joint and can then be adjusted to a tight fitting by placing screw 340 through holes 329 and tightening. Preferably, base 312 comprises lower rim 320 with ridge 322, detent rim 330, upward projection 338, and walls 346. Optionally, holders 335 are added to lower rim 320. Preferably, one or more connectors 339 are disposed on top of walls 346 for the user to optionally place overarching bridge cover 314, which preferably curves sufficiently to allow the user's finger to interact with the nozzle's actuator to be pressed down and spray unrestricted. FIG. 45 shows and embodiment similar to the one in FIG. 44 but without holders on the lower rim.

Figure 46:
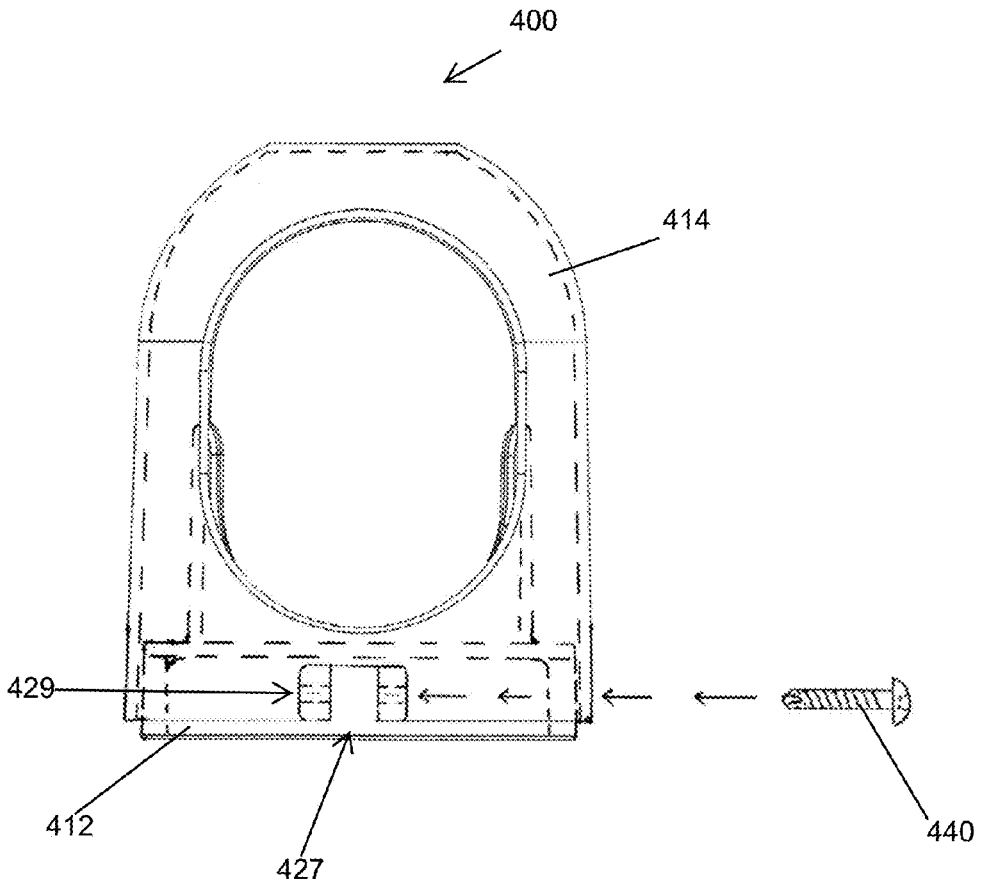
FIG. 46 is a front view of an embodiment of a different embodiment of the invention wherein a clamp assembly is disposed at the base of the shell component.

Referring to FIG. 46, there is shown a different embodiment of the invention in which nozzle assembly protector 400 comprises shell 414 disposed on base 412. Preferably, shell 414 further comprises clamp assembly 427 comprising, for example, holes 429 in which screw 440 is inserted and tightened to secure protector 400 onto, for example, the rolled joint of a spray can.

Figure 47:
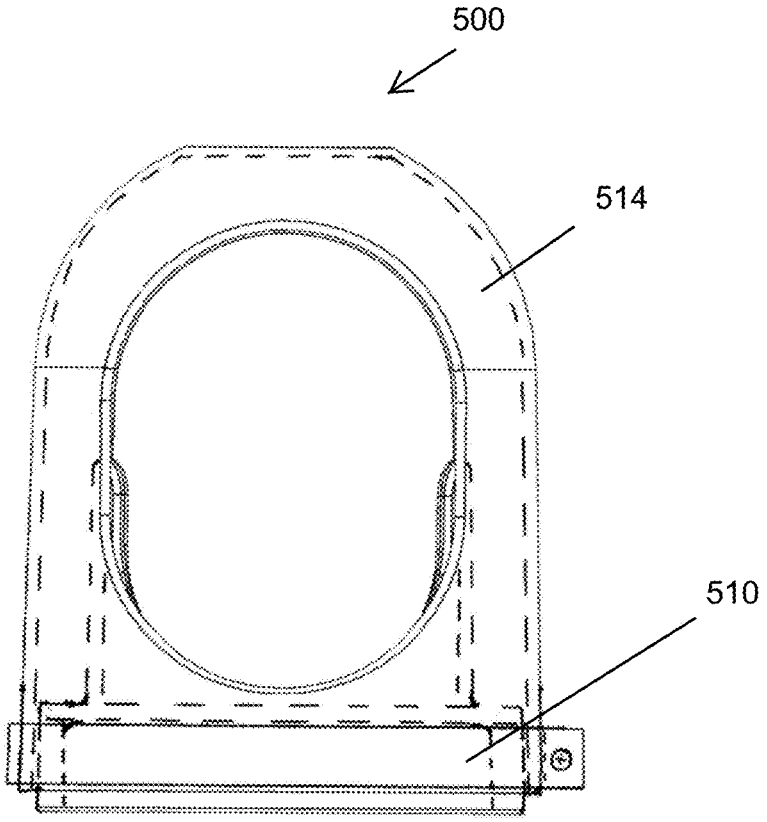
FIG. 47 is a front view of an embodiment similar to the embodiment of FIG. 46 but the clamp assembly comprises a detachable clamp that can be tightened with, for example, a screw.
Figure 48:
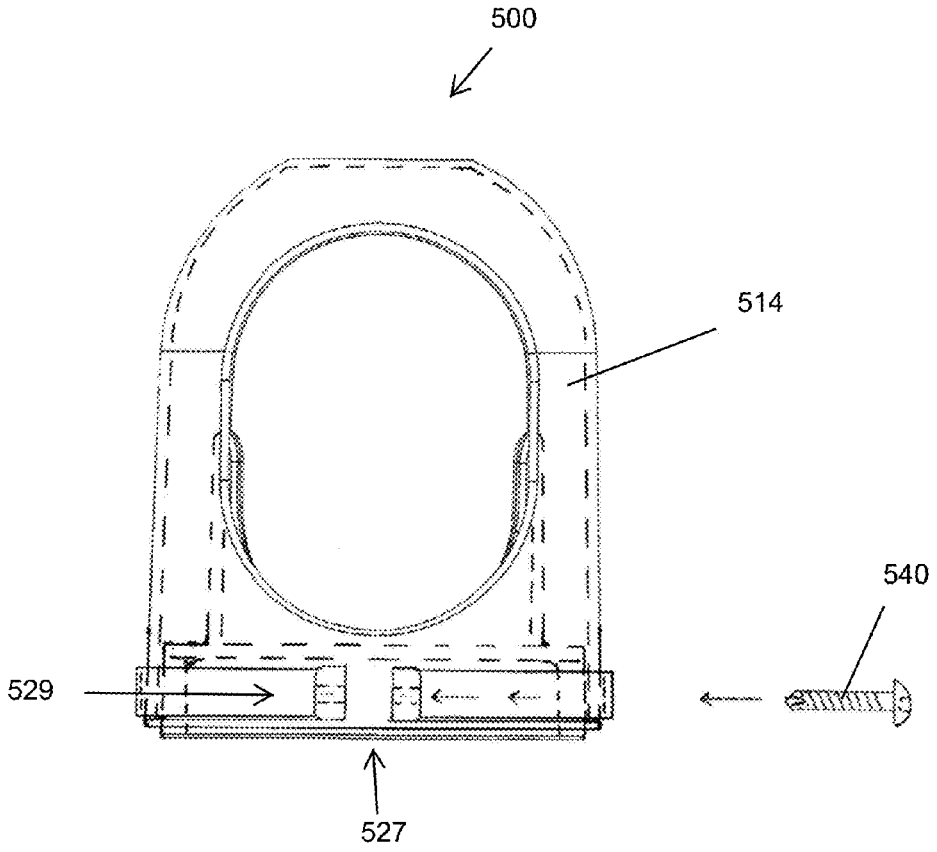
FIG. 48 is a front view of an embodiment similar to the embodiment of FIG. 47 with a clamp spun about the base of the shell.

As illustrated in FIGS. 47-48, optionally, nozzle assembly protector 500 preferably comprises clamp 510, which is disposed at the base of shell 514 to secure protector 500 onto, for example, the rolled joint of a spray can. Preferably, clamp 510 comprises clamp assembly 527 with, for example, holes 529 for screw 540 to be inserted and tightened.

In a different embodiment, nozzle assembly protector 600 comprises shell 614 with hook and loop components 617.

INDUSTRIAL APPLICABILITY

The invention is further illustrated by the following non-limiting examples.

Example 1

Several issues arose in trying to make a one piece protector, either one that extended just above the nozzle-button, or one that fully covered it. For example, during low angle drops, too much stiffness led to damage of either the protector, due to brittle fracture, or the can, primarily at the valve cup/dome interface, leading to leakage, or both. When softened, the one piece protector collapsed partially and absorbed energy, thus preventing damage to the can during low angles, but this softness became an issue during high angle drops, also resulting in damage to can/protector. Too much stiffness led to a spring loading effect that sent the one piece protector flying upon impact and also caused the can to bounce wildly. Many attempts were made to alter the shape, and plastic composition, of one piece designs in order to provide both high angle impact stiffness and low angle impact absorption, including the attachment of impact absorbing materials. During high angle drops it was noticed that the single piece protectors had a tendency to dislodge and slide across the face of the valve cup, directly damaging the nozzle assembly. Because single piece designs were found to be less effective, a two piece embodiment was developed instead.

A base component was fabricated to firmly attach to the outer lip of the seal between the valve cup and the dome. The base component comprised deflector walls. A cover component attached to the base by a short mount that allowed the cover to revolve about the long axis while holding firmly to the base to permit an opening and closing action. The cover attachment to the base was designed to release before that of the base/can attachment so that the base remained on the can for a possible secondary impact as the cover was moving out of the way. In order to arrest the lateral movement of the cover during impact and force the cover to pivot about the point of contact, an outer retaining wall was added to the base component, and/or restraints were added, and/or the clamp. The corners of the deflectors of the base component were relieved and the thickness and composition adjusted to allow the cover component to pivot over them without significant interference, while still providing sufficient protection during secondary impacts.

It was observed during testing that for effective protection at low angle drops, the cover component had to simply absorb the impact without deflecting too much and contacting the actuator. At higher angles, in contrast, the cover component made contact with the surface and had to begin absorbing energy, while at the same time imparting a certain amount of force upon the can in order to slightly start increasing the can's angle of impact as the cover component began pivoting. This absorption and re-direction lessened the forces received by the base component when it came in contact with the surface. Many times, higher initial angles resulted in enough cover component imparted re-direction of the can for the base component to avoid contact with the surface. Thus, a secondary impact was shifted to the shoulder of the can. A hole in the top of the shell was added to slow down this absorption and re-direction phase, thereby increasing their effect.

The preceding examples can be repeated with similar success by substituting the generically or specifically described components and/or parameters of this invention for those used in the preceding examples. Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A protector for a nozzle actuator assembly for an aerosol spray can comprising:

a detachable shell comprising at least two opposing openings;

a circular base comprising a top surface and a bottom surface;

said top surface comprising at least one cylindrical upward first projection that forms one or more walls to protect said nozzle actuator assembly, and a second cylindrical upward projection smaller in diameter than an inner diameter of said shell, and onto which said shell connects;

said bottom surface comprising a downward cylindrical third projection at its outermost periphery that forms a lower rim; and said lower rim comprising a concentric first ridge.

2. The protector of claim 1 wherein said first ridge is curved inwardly.

3. The protector of claim 1 wherein a most inner perimeter of said first ridge is smaller than an outer diameter of a most inner rolled joint of said spray can.

4. The protector of claim 1 wherein said shell is rotatable relative to said base.

5. The protector of claim 4 wherein said top surface further comprises a fourth cylindrical upward projection disposed outwardly in relation to said second cylindrical upward projection and larger in diameter than an outer diameter of said shell.

6. The protector of claim 5 wherein said fourth cylindrical upward projection comprises a first detent and said shell comprises second and third detents that are capable of interlocking with said first detent to lock said shell in either an open or closed configuration.

7. The protector of claim 6 wherein said second and fourth projections comprise a cutout portion to allow a spray to flow unrestricted.

8. The protector of claim 3 wherein said base clamps around said rolled joint.

9. The protector of claim 3 wherein said shell extends downward over said base and is capable of being clamped over said most inner rolled joint.

10. The protector of claim 1 wherein said shell is connected to said one or more walls to protect said nozzle assembly and is shaped as an arching bridge with enough space under it to allow a finger of a user to enter to operate said nozzle assembly on one side and to allow spray to exit said nozzle assembly unrestricted on another side of said shell.

11. The protector of claim 1 wherein said base and said shell are molded out of plastic.

12. The protector of claim 1 wherein said shell opposing openings are sufficiently large to allow a finger of a user to enter to operate said nozzle assembly on one side and to allow spray to exit said nozzle assembly unrestricted on another side of said shell.

13. The protector of claim 1 wherein said lower rim has a perimeter larger than a most outer rolled joint of said spray can, and said first ridge has a perimeter smaller than an outer diameter of said most outer rolled joint of said spray can.

14. The protector of claim 1 wherein said at least one cylindrical upward first projection that forms one or more walls is integrally formed with said base.

15. A protector for a nozzle actuator assembly for an aerosol spray can comprising:

a shell comprising at least two opposing openings and a top circular opening;

a circular base comprising a top surface and a bottom surface;

said top surface comprising at least one cylindrical upward first projection that forms one or more walls to protect said nozzle actuator assembly;

said bottom surface comprising a downward cylindrical second projection at its outermost periphery that forms a lower rim; and said lower rim comprising a concentric first ridge.

16. The protector of claim 15 wherein said top opening accommodates decorative attachments.

17. A protector for a nozzle actuator assembly for an aerosol spray can comprising:

a detachable shell comprising at least two opposing openings;

a circular base comprising a top surface and a bottom surface;

said top surface comprising at least one cylindrical upward first projection that forms one or more walls to protect said nozzle actuator assembly;

said bottom surface comprising a downward cylindrical second projection at its outermost periphery that forms a lower rim;

said lower rim comprising a concentric first ridge; and said detachable shell and said base comprising at least one hook to accommodate an elastic restraint.

18. The protector of claim 17 wherein said lower rim is detachable from said circular base.

* * * * *